US005629671A

United States Patent [19]

Morita

[11] Patent Number: 5,629,671

[45] Date of Patent: May 13, 1997

[54] PHOTOELECTRIC TYPE FIRE DETECTOR AND ADJUSTMENT UNIT THEREFOR

[75] Inventor: Toshikazu Morita, Tokyo, Japan

[73] Assignee: Nohmi Bosai Ltd., Tokyo, Japan

[21] Appl. No.: 358,257

[22] Filed: Dec. 19, 1994

[30] Foreign Application Priority Data

Dec. 22, 1993 [JP] Japan ..... 5-325040

[51] Int. Cl.[6] ..... G08B 29/00

[52] U.S. Cl. ..... 340/515; 340/628; 340/629; 340/630

[58] Field of Search ..... 340/630, 629, 340/628, 515; 250/574, 237 R

[56] References Cited

U.S. PATENT DOCUMENTS

| | | | |
|---|---|---|---|
| 3,916,209 | 10/1975 | Steele et al. | 340/630 |
| 4,099,178 | 7/1978 | Ranney et al. | 340/515 |
| 4,144,458 | 3/1979 | Doherty | 340/515 |
| 4,144,459 | 3/1979 | Malinowski | 340/515 |
| 4,651,013 | 3/1987 | Kajii et al. | 340/630 |
| 5,225,810 | 7/1993 | Inoue et al. | 340/630 |
| 5,280,272 | 1/1994 | Nagashima | 340/630 |
| 5,473,314 | 12/1995 | Mochizuki et al. | 340/630 |

FOREIGN PATENT DOCUMENTS

WO9502230 1/1995 WIPO .

OTHER PUBLICATIONS

Patent Abstracts of Japan, vol. 18, No. 110 (P-1698) 22 Feb. 1994.

*Primary Examiner*—Brent A. Swarthout
*Assistant Examiner*—Van T. Trieu
*Attorney, Agent, or Firm*—Wenderoth, Lind & Ponack

[57] ABSTRACT

A photoelectric type fire detector is capable of accurately adjusting sensitivity using a scattering and translucent plate and exhibits excellent reliability. The photoelectric type fire detector has a first detection unit and a fourth detection unit for respectively detecting a first received output and a fourth received output from a smoke detection portion realized when the light emitting device emits light and does not emit light in a case where the scattering and translucent plate is not inserted and as well as when no smoke is present, a second detection unit and a third detection unit for respectively detecting a second received output and a third received output from the smoke detection portion realized when the light emitting device emits light and does not emit light in a case where the scattering and translucent plate is inserted and as when well as no smoke is present, and a calculating unit for calculating the physical quantity of smoke with respect to a received output from the smoke detection portion realized when the light emitting device emits light and does not emit light in a state where a fire is supervised based on the first to fourth received outputs and smoke density of the scattering and translucent plate realized when the second and third received output have been obtained.

23 Claims, 10 Drawing Sheets

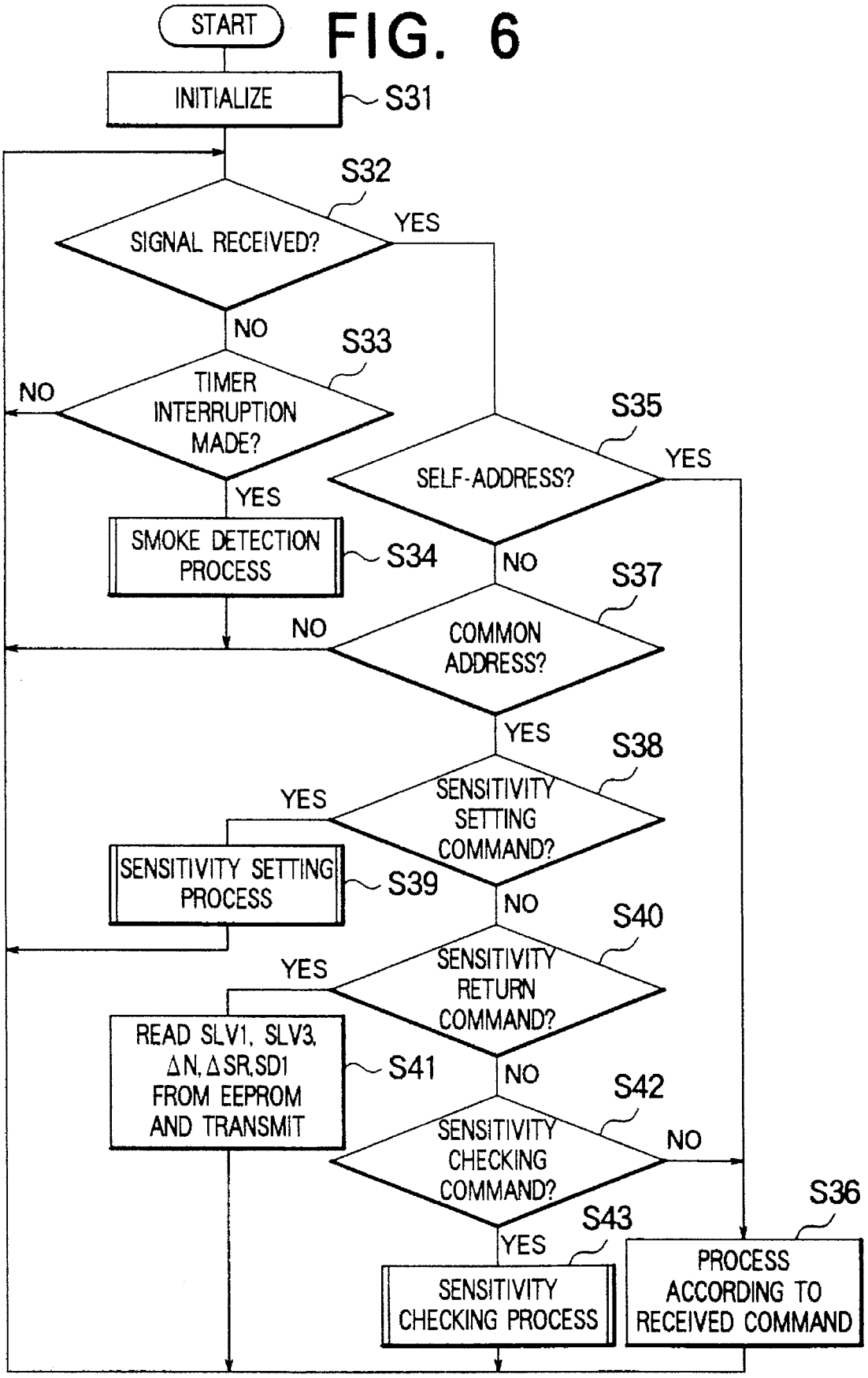
FIG. 6
START
INITIALIZE
S31
S32
SIGNAL RECEIVED?
YES
NO
S33
TIMER INTERRUPTION MADE?
NO
YES
SMOKE DETECTION PROCESS
S34
S35
SELF-ADDRESS?
YES
NO
S37
COMMON ADDRESS?
NO
YES
S38
SENSITIVITY SETTING COMMAND?
YES
SENSITIVITY SETTING PROCESS
S39
NO
S40
SENSITIVITY RETURN COMMAND?
YES
READ SLV1, SLV3, ΔN, ΔSR, SD1 FROM EEPROM AND TRANSMIT
S41
NO
S42
SENSITIVITY CHECKING COMMAND?
NO
YES
S43
SENSITIVITY CHECKING PROCESS
S36
PROCESS ACCORDING TO RECEIVED COMMAND

PHOTOELECTRIC TYPE FIRE DETECTOR AND ADJUSTMENT UNIT THEREFOR

BACKGROUND OF THE INVENTION

1. Field of the Invention

This invention relates to a photoelectric type fire detector of a normal type for transmitting a fire signal when it has detected smoke reaching a level at which the start of a fire is determined or an analog type which detects a physical quantity of smoke and transmits a physical quantity signal and an adjustment unit therefor, and more particularly to a photoelectric type fire detector having a sensitivity adjustment function and an adjustment unit therefor.

2. Description of the Related Art

In order to adjust the sensitivity of a photoelectric type fire detector, a sensitivity adjustment method has been employed which uses a light scattering plate. The light scattering plate is manufactured by adding light reflecting substances, such as metal powder, to a transparent synthetic resin plate in such a manner that light is, by the reflecting substances, scattered in a quantity that is the same as the quantity which is realized by smoke of a density of, for example 10%/m.

Another method has been disclosed by the applicant of the present invention (refer to Japanese Patent Publication No. 4-131538), the method having the steps of: using a scattering and translucent plate which has been manufactured by adding, in place of smoke particles, carbon particles in an arbitrary quantity to a translucent plate made of black and opaque plastic resin, such as AS resin, having a light permeability; and inserting the scattering and translucent plate between a smoke detection light emitting device and a light receiving device.

However, the conventional sensitivity adjustment method using the light scattering plate involves a difficulty in manufacturing the light scattering plate that is adjusted in its quantity of scattered light to a value that corresponds to the smoke density of 10%/m.

In the case where the foregoing method is employed, when the light scattering plate is inserted between the light emitting device and the light receiving device, light emitted by the light emitting device is scattered by the light reflecting substances, such as metal powder, included in the light scattering plate, and the scattered light is incident on the light receiving device as a signal light component. On the other hand, light reflected by the internal wall of the black box passes through the light scattering plate, and light passed through the light scattering plate and reached the internal wall of the black box is reflected by the internal wall. Thus, foregoing light beams are respectively received by the light receiving device as noise components. Therefore, the light receiving device receives light serving as the signal component scattered by the light reflecting substances and light serving as the noise components reflected by the internal wall of the black box.

However, although the light scattering plate is the transparent member, the light scattering plate obscures light when light passes through the same. Therefore, the noise light component reflected by the internal wall of the black box is reduced as compared with the quantity at the time of supervising a fire. Such reduction leads to a fact that the sensitivity or an analog output (the physical quantity of smoke) in fire discrimination is disordered by a degree corresponding to the foregoing reduction. It might therefore be considered feasible to perform correction at the time of the sensitivity adjustment such that the degree of the reduction in the received output is added by means of the light scattering plate. However, there arises a problem in that dispersion among black boxes and slight difference in the positions, at which the light emitting device and the light receiving device are attached, result in that accurate correction cannot be performed.

The other conventional method using the scattering and translucent plate to adjust the sensitivity permits the quantity of addition of the carbon particles to be determined arbitrarily. Furthermore, since the sensitivity is adjusted in accordance with the arbitrary smoke density with respect to the quantity of the addition, the scattering and translucent plate can be manufactured easily.

When the scattering and translucent plate is, in the black box of the fire detector, inserted between the light emitting device and the light receiving device, light introduced from the light emitting device into the scattering and translucent plate is scattered by carbon particles approximating smoke particles. The scattered light is incident on the light receiving device as the signal light component. On the other hand, light reflected by the internal wall of the black box at a position near the light emitting device as compared with the scattering and translucent plate is considerably obscured by the black scattering and translucent plate. Furthermore, light directly passes through the scattering and translucent plate is considerably decayed by the black scattering and translucent plate. In addition, the light is further obscured due to the reflection on the internal wall of the black box. Therefore, the light receiving device receives the noise light reflected by the internal wall of the black box in a quantity that can be substantially ignored as compared with the foregoing method. Thus, the light receiving device receives the light scattered by the carbon particles as the signal light component. Namely, the light receiving device receives only light scattered by smoke in a state where no noise light is present. Therefore, an output accurately representing the received light with respect to an arbitrary smoke density can be obtained.

However, the foregoing method involves a fact that the light receiving device receives the noise light component reflected by the internal wall of the black box when the light emitting device emits light at the time of supervises a fire. Thus, the sensitivity or the analog output (the physical quantity of smoke) to discriminate a fire is disordered by a degree corresponding to the received noise light component. As a result, it might therefore be feasible to perform correction by adding the noise light component at the time of adjusting the sensitivity by means of the scattering and translucent plate. Similarly, there arises a problem in that dispersion among black boxes and slight difference in the positions, at which the light emitting device and the light receiving device are attached, result in that accurate correction cannot be performed.

SUMMARY OF THE INVENTION

The present invention is directed to overcome the foregoing problems and an object of the present invention is to provide a photoelectric type fire detector capable of accurately adjusting the sensitivity by using a scattering and translucent plate and exhibiting excellent reliability.

According to one aspect of the present invention., there is provided a photoelectric type fire detector comprising: first detection means for detecting a first received output from a smoke detection portion realized when a light emitting device emits light in a case where a scattering and translucent plate is not inserted and as well as no smoke is present; second detection means for detecting a second received output from the smoke detection portion realized when the light emitting device emits light in a case where the scattering and translucent plate is inserted and as well as no smoke is present; and calculating means for calculating the physical quantity of smoke with respect to a received output from the smoke detection portion realized when the light emitting device emits light in a state where a fire is supervised based on the first received output, the second received output and a smoke density of the scattering and translucent plate realized when the second received output has been obtained. As a result of the foregoing structure, influence of dispersion of the shape among black boxes and slight differences in the positions, at which the light emitting device and the light receiving device are attached, taking place in each of a plurality of analog photoelectric type fire detectors can be eliminated and the sensitivity can always accurately be set. Furthermore, information required to set the sensitivity can be held even in an abnormal state such as an interruption of power supply, and therefore the reliability can be improved. Furthermore, the structure can be simplified.

According to another aspect of the present invention, there is provided a photoelectric type fire detector comprising: first detection means for detecting a first received output from a smoke detection portion realized when a light emitting device emits light in a case where a scattering and translucent plate is not inserted and as well as no smoke is present; second detection means for detecting a second received output from the smoke detection portion realized when the light emitting device emits light in a case where the scattering and translucent plate is inserted and as well as no smoke is present; third detection means for detecting a third received output from the smoke detection portion realized when the light emitting device does not emit light in a case where the scattering and translucent plate is inserted and as well as no smoke is present; and calculating means for calculating the physical quantity of smoke with respect to a received output from the smoke detection portion realized when the light emitting device emits light in a state where a fire is supervised based on the first received output, the second received output, the third received output and a smoke density of the scattering and translucent plate realized when the second received output and the third received output have been obtained. According to the foregoing structure, influence of dispersion of the shape among black boxes and slight differences in the positions, at which the light emitting device and the light receiving device are attached, taking place in each of a plurality of analog photoelectric type fire detectors can be eliminated and the sensitivity can be set further accurately. Furthermore, information required to set the sensitivity can be held even in an abnormal state such as interruption of power supply, and therefore the reliability can be improved. Furthermore, the structure can be simplified.

According to another aspect of the present invention, there is provided a photoelectric type fire detector comprising: first detection means for detecting a first received output from a smoke detection portion realized when a light emitting device emits light in a case where a scattering and translucent plate is not inserted and as well as no smoke is present; second detection means for detecting a second received output from the smoke detection portion realized when the light emitting device emits light in a case where the scattering and translucent plate is inserted and as well as no smoke is present; third detection means for detecting a third received output from the smoke detection portion realized when the light emitting device does not emit light in a case where the scattering and translucent plate is inserted and as well as no smoke is present; fourth detection means for detecting a fourth received output from the smoke detection portion realized when the light emitting device does not emit light in a case where the scattering and translucent plate is not inserted and as well as no smoke is present; and calculating means for calculating the physical quantity of smoke with respect to a received output from the smoke detection portion realized when the light emitting device emits light in a state where a fire is supervised based on the first received output, the second received output, the third received output, the fourth received output and a smoke density of the scattering and translucent plate realized when the second received output and the third received output have been obtained. According to the foregoing structure, influence of dispersion of the shape among black boxes and slight differences in the positions, at which the light emitting device and the light receiving device are attached, taking place in each of a plurality of analog photoelectric type fire detectors can be eliminated and the sensitivity can be set further accurately. Furthermore, information required to set the sensitivity can be held even in an abnormal state such as interruption of power supply, and therefore the reliability can be improved. Furthermore, the structure can be simplified.

According to still another aspect of the present invention, there is provided a photoelectric type fire detector comprising: first detection means for detecting a first received output from a smoke detection portion realized when a light emitting device emits light in a case where a scattering and translucent plate is not inserted and as well as no smoke is present; second detection means for detecting a second received output from the smoke detection portion realized when the light emitting device emits light in a case where the scattering and translucent plate is inserted and as well as no smoke is present; and calculating means for calculating a fire discrimination level based on the first received output, the second received output and a smoke density of the scattering and translucent plate realized when the second received output has been obtained. According to the foregoing structure, influence of dispersion of the shape among black boxes and slight differences in the positions, at which the light emitting device and the light receiving device are attached, taking place in each of a plurality of normal-type photoelectric type fire detectors can be eliminated and the sensitivity can always accurately be set. Furthermore, information required to set the sensitivity can be held even in an abnormal state such as interruption of power supply, and therefore the reliability can be improved. Furthermore, the structure can be simplified.

According to a further aspect of the present invention, there is provided a photoelectric type fire detector comprising: first detection means for detecting a first received output from a smoke detection portion realized when a light emitting device emits light in a case where a scattering and translucent plate is not inserted and as well as no smoke is present; second detection means for detecting a second received output from the smoke detection portion realized when the light emitting device emits light in a case where the scattering and translucent plate is inserted and as well as no smoke is present; third detection means for detecting a third received output from the smoke detection portion realized when the light emitting device does not emit light in a case where the scattering and translucent plate is inserted and as well as no smoke is present; and calculating means for calculating a fire discrimination level based on the first received output, the second received output, the third received output and a smoke density of the scattering and translucent plate realized when the second received output and the third received output have been obtained. According to the foregoing structure, influence of dispersion of the shape among black boxes and slight differences in the positions, at which the light emitting device and the light receiving device are attached, taking place in each of a plurality of normal-type photoelectric type fire detectors can be eliminated and the sensitivity can be set further accurately. According to the foregoing structure, influence of dispersion of the shape among black boxes and slight differences in the positions, at which the light emitting device and the light receiving device are attached, taking place in each of a plurality of normal-type photoelectric type fire detectors can be eliminated and the sensitivity can be set further accurately. In addition, influence of dispersion of the shape among black boxes and slight differences in the positions, at which the light emitting device and the light receiving device are attached, taking place in each of a plurality of analog or normal-type photoelectric type fire detectors can be eliminated and the sensitivity can be set further accurately. Furthermore, the structure can be simplified.

According to a further aspect of the present invention, there is provided a photoelectric type fire detector comprising: first detection means for detecting a first received output from a smoke detection portion realized when a light emitting device emits light in a case where a scattering and translucent plate is not inserted and as well as no smoke is present; second detection means for detecting a second received output from the smoke detection portion realized when the light emitting device emits light in a case where the scattering and translucent plate is inserted and as well as no smoke is present; third detection means for detecting a third received output from the smoke detection portion realized when the light emitting device does not emit light in a case where the scattering and translucent plate is inserted and as well as no smoke is present; fourth detection means for detecting a fourth received output from the smoke detection portion realized when the light emitting device does not emit light in a case where the scattering and translucent plate is not inserted and as well as no smoke is present; and calculating means for calculating a fire discrimination level based on the first received output, the second received output, the third received output, the fourth received output and a smoke density of the scattering and translucent plate realized when the second received output and the third received output have been obtained. As a result of the foregoing structure, influence of dispersion of the shape among black boxes and slight differences in the positions, at which the light emitting device and the light receiving device are attached, taking place in each of a plurality of normal-type photoelectric type fire detectors can be eliminated and the sensitivity can always be set. Furthermore, information required to set the sensitivity can be held even in an abnormal state such as interruption of power supply, and therefore the reliability can be improved. Furthermore, the structure can be simplified.

According to a further aspect of the present invention, there is provided a photoelectric type fire detector comprising: first detection means for detecting a first received output from a smoke detection portion realized when a light emitting device emits light in a case where a scattering and translucent plate is not inserted and as well as no smoke is present; second detection means for detecting a second received output from the smoke detection portion realized when the light emitting device emits light in a case where the scattering and translucent plate is inserted and as well as no smoke is present; third detection means for detecting a third received output from the smoke detection portion realized when the light emitting device does not emit light in a case where the scattering and translucent plate is inserted and as well as no smoke is present; fourth detection means for detecting a fourth received output from the smoke detection portion realized when the light emitting device does not emit light in a case where the scattering and translucent plate is not inserted and as well as no smoke is present; storage means for storing the fourth received output and a smoke density of the scattering and translucent plate realized when the second received output and the third received output have been obtained, for storing, as a noise light component, a received output obtained by subtracting the fourth received output from the first received output and for storing, as reference signal light component, a received output obtained by subtracting the third received output from the second received output; and calculating means for calculating the physical quantity of smoke with respect to a received output from the smoke detection portion realized when the light emitting device emits light in a state where a fire is supervised based on the fourth received output, the smoke density of the scattering and translucent plate, the noise light component and the reference signal light component. As a result of the foregoing structure, influence of dispersion of the shape among black boxes and slight differences in the positions, at which the light emitting device and the light receiving device are attached, taking place in each of a plurality of analog photoelectric type fire detectors can be eliminated and the sensitivity can accurately and precisely be set.

According to a further aspect of the present invention, there is provided a photoelectric type fire detector comprising: first detection means for detecting a first received output from a smoke detection portion realized when a light emitting device emits light in a case where a scattering and translucent plate is not inserted and as well as no smoke is present; second detection means for detecting a second received output from the smoke detection portion realized when the light emitting device emits light in a case where the scattering and translucent plate is inserted and as well as no smoke is present; third detection means for detecting a third received output from the smoke detection portion realized when the light emitting device does not emit light in a case where the scattering and translucent plate is inserted and as well as no smoke is present; fourth detection means for detecting a fourth received output from the smoke detection portion realized when the light emitting device does not emit light in a case where the scattering and translucent plate is not inserted and as well as no smoke is present; storage means for storing the fourth received output and a smoke density of the scattering and translucent plate realized when the second received output and the third received output have been obtained, for storing, as a noise light component, a received output obtained by subtracting the fourth received output from the first received output and for storing, as a reference signal light component, a received output obtained by subtracting the third received output from the second received output; and calculating means for calculating a fire discrimination level based on the fourth received output, the smoke density of the scattering and translucent plate, the noise light component and the reference signal light component. As a result of the foregoing structure, influence of dispersion of the shape among black boxes and slight differences in the positions, at which the light emitting device and the light receiving device are attached, taking place in each of a plurality of normal-type photoelectric type fire detectors can be eliminated and the sensitivity can accurately and precisely be set.

According to a further aspect of the present invention, there is provided an adjustment apparatus comprising: an adjustment unit having: first receiving means for receiving a first received output from a smoke detection portion realized when a light emitting device emits light in a case where a scattering and translucent plate is not inserted into a fire detector and as well as no smoke is present; second receiving means for receiving a second received output from the smoke detection portion realized when the light emitting device emits light in a case where the scattering and translucent plate is inserted into the fire detector and as well as no smoke is present; calculating means for calculating physical quantity characteristics of smoke with respect to a received output of the fire detector or a fire discrimination level based on the first received output, the second received output and the smoke density of the scattering and translucent plate when the second received output has been obtained; and transmission means for transmitting, to the fire detector, the physical quantity characteristics of smoke with respect to the received output of the fire detector or the fire discrimination level obtained by the calculating means, wherein the fire detector comprises: transmission means for transmitting at least the first received output and the second received output; and storage means for storing the physical quantity characteristics of smoke with respect to the received output or the fire discrimination level transmitted by the adjustment unit. As a result of the foregoing structure, influence of dispersion of the shape among black boxes and slight differences in the positions, at which the light emitting device and the light receiving device are attached, taking place in each of a plurality of analog or normal-type photoelectric type fire detectors can be eliminated and the sensitivity can always and accurately be set.

According to a further aspect of the present invention, there is provided an adjustment apparatus comprising an adjustment unit having: first receiving means for receiving a first received output from a smoke detection portion realized when a light emitting device emits light in a case where a scattering and translucent plate is not inserted into a fire detector and as well as no smoke is present; second receiving means for receiving a second received output from the smoke detection portion realized when the light emitting device emits light in a case where the scattering and translucent plate is inserted into the fire detector and as well as no smoke is present; third receiving means for receiving a third received output from the smoke detection portion realized when the light emitting device does not emit light in a case where the scattering and translucent plate is inserted into the fire detector and as well as no smoke is present; calculating means for calculating physical quantity characteristics of smoke with respect to a received output of the fire detector or a fire discrimination level based on the first received output, the second received output, the third received output and the smoke density of the scattering and translucent plate when the second received output and the third received output have been obtained; and transmission means for transmitting, to the fire detector, the physical quantity characteristics of smoke with respect to the received output of the fire detector or the fire discrimination level obtained by the calculating means, wherein the fire detector comprises: transmission means for transmitting at least the first received output, the second received output and the third received output; and storage means for storing the physical quantity characteristics of smoke with respect to the received output or the fire discrimination level transmitted by the adjustment unit. As a result of the foregoing structure, influence of dispersion of the shape among black boxes and slight differences in the positions, at which the light emitting device and the light receiving device are attached, taking place in each of a plurality of analog or normal-type photoelectric type fire detectors can be eliminated and the sensitivity can be set further accurately.

According to a further aspect of the present invention, there is provided an adjustment apparatus comprising an adjustment unit having: first receiving means for receiving a first received output from a smoke detection portion realized when a light emitting device emits light in a case where a scattering and translucent plate is not inserted into a fire detector and as well as no smoke is present; second receiving means for receiving a second received output from the smoke detection portion realized when the light emitting device emits light in a case where the scattering and translucent plate is inserted into the fire detector and as well as no smoke is present; third receiving means for receiving a third received output from the smoke detection portion realized when the light emitting device does not emit light in a case where the scattering and translucent plate is inserted into the fire detector and as well as no smoke is present; fourth detection means for detecting a fourth received output from the smoke detection portion realized when the light emitting device does not emit light in a case where the scattering and translucent plate is not inserted into the fire detector and as well as no smoke is present; first calculating means for calculating physical quantity characteristics of smoke with respect to a received output of the fire detector or a fire discrimination level when the light emitting device emits light in a state where a fire is supervised based on the first received output, the second received output, the third received output, the fourth received output and the smoke density of the scattering and translucent plate when the second received output and the third received output have been obtained; second calculating means for calculating physical quantity characteristics of smoke with respect to the received output of the fire detector or the fire discrimination level in accordance with the first received output, the second received output, the third received output and the smoke density of the scattering and translucent plate when the second received output and the third received output have been obtained; and transmission means for transmitting, to the fire detector, the physical quantity characteristics of smoke with respect to the received output of the fire detector or the fire discrimination level obtained by the second calculating means, wherein the fire detector comprises: transmission means for transmitting at least the first received output, the second received output, the third received output and the fourth received output; and storage means for storing the physical quantity characteristics of smoke with respect to the received output or the fire discrimination level transmitted by the adjustment unit. As a result of the foregoing structure, influence of dispersion of the shape among black boxes and slight differences in the positions, at which the light emitting device and the light receiving device are attached, taking place in each of a plurality of analog or normal-type photoelectric type fire detectors can be eliminated and the sensitivity can be set further accurately.

BRIEF DESCRIPTION OF THE DRAWINGS

FIG. 6 is a flow chart for showing the operation of the fire detector shown in FIG. 1;

DESCRIPTION OF THE PREFERRED EMBODIMENT

An embodiment of the present invention will now be described with reference to the drawings.

Figure 1:
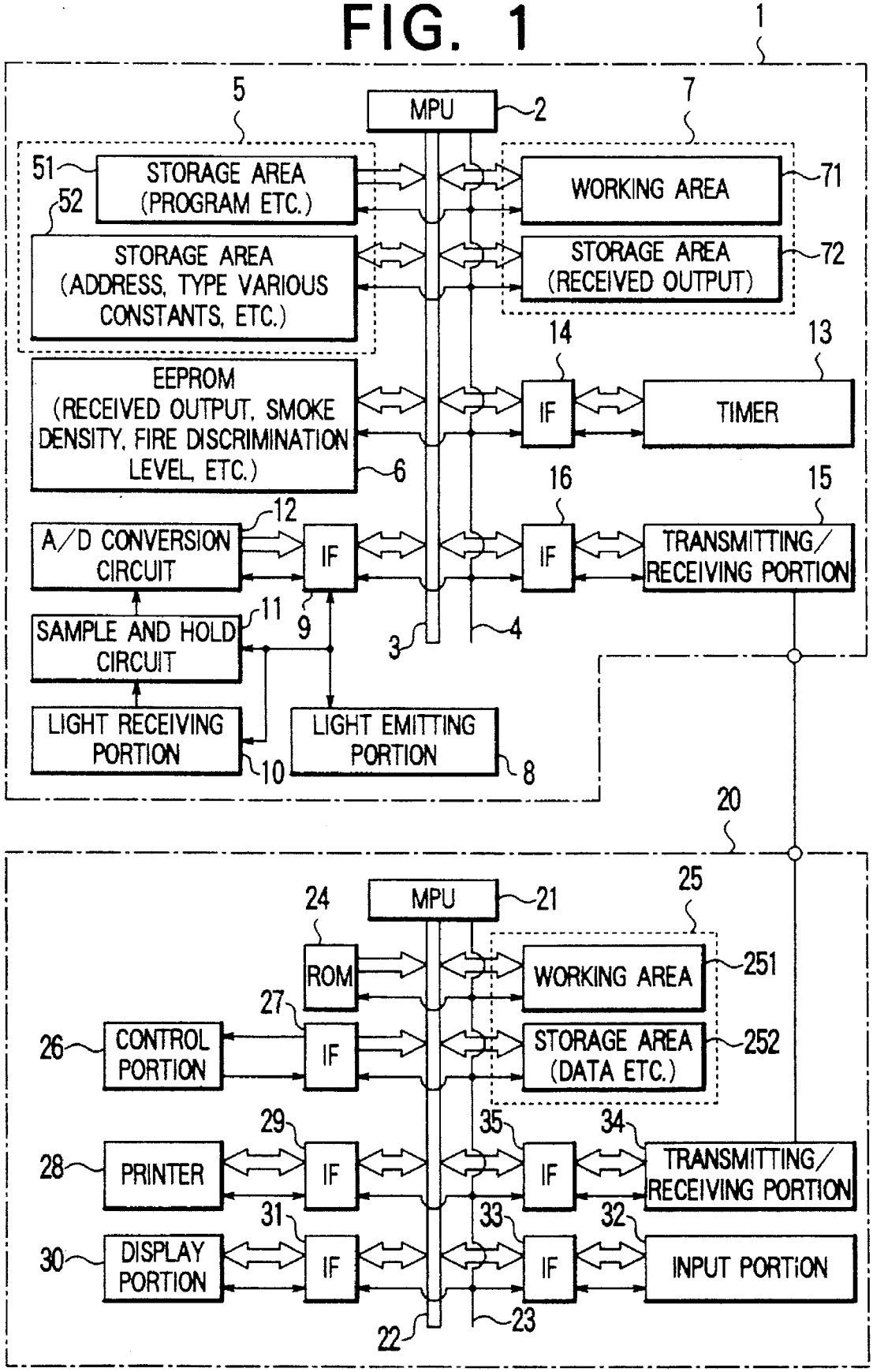
FIG. 1 is a block diagram which illustrates an embodiment of the present invention.

FIG. 1 is a block diagram which illustrates the embodiment of the present invention.

Referring to FIG. 1, a photoelectric type fire detector 1 (hereinafter called a "fire detector") comprises: a microprocessor unit (hereinafter called an "MPU") 2 serving as a calculating means for performing a variety of calculation operations to be described later; a data bus 3 and a control bus 4 respectively connected to the MPU 2; a read only memory (hereinafter called a "ROM") 5 serving as a storage means connected to the MPU 2 through the data bus 3 and the control bus 4; an EEPROM 6 connected to the MPU 2 through the data bus 3 and the control bus 4 and serving as an electrically writing/erasable (i.e., rewritable) non-volatile storage means. The ROM 5 has a storage area 51, in which a program relating to flow charts shown in FIGS. 4 to 7 to be described later and the like are previously stored, and a storage area 52, in which common address, self-address, type, various constants and the like are previously stored. The EEPROM 6 stores: smoke density (equivalent to real smoke) SD1 of a scattering and translucent plate; output SLV1 representing light received, (detected) by a light receiving device to be described later when a light emitting device to be described later emits light in a state where the scattering and translucent plate is not inserted at the time of adjusting the sensitivity and as well as no smoke is present; output SLV2 representing light received by the light receiving device when the light emitting device does not emit light in the same state as the foregoing state; output SLV3 representing light received by the light receiving device when the light emitting device emits light in a state where a scattering and translucent plate corresponding to a smoke density of SD1 is inserted and as well as no smoke is present; output SLV4 representing light received by the light receiving device when the light emitting device does not emit light in the same state as the foregoing state; SLV1–SLV2, that is, noise (light) component AN realized by light irregularly reflected by the internal wall of an optical chamber (a dark room) (not shown) when the light emitting device emits light; SLV3–SLV4, that is, signal light component ΔSR which is an output representing received scattered light realized by the scattering and translucent plate when the scattering and translucent plate corresponding to the smoke density of SD1 is inserted into the optical chamber, the signal light component ΔSR including no noise light component; and fire discrimination level FL (in a case of a normal type fire detector). A RAM with a backup power source or the like may be employed in place of the EEPROM.

The fire detector 1 comprises a random access memory (hereinafter called a "RAM") 7 serving as a storage means connected to the MPU 2 through the data bus 3 and the control bus 4. The RAM 7 has a working area 71 for use when the MPU 2 performs the calculating operation, and a storage area 72 for updating and storing outputs representing detected (outputs representing received) fire phenomenon for a plurality of latest operations (for example, three continuous operations for every three seconds).

The fire detector 1 comprises: a light emitting portion 8 connected to the MPU 2 through an interface (hereinafter called a "IF") 9, the data bus 3 and the control bus 4 and having a smoke detection light emitting device, a light emission control circuit and the like; a light receiving portion 10 connected to the MPU 2 through the IF 9, the data bus 3 and the control bus 4 and having a smoke detection light receiving device, an amplifying circuit and the like; a sample and hold circuit 11 connected to the MPU 2 through the IF 9, the data bus 3 and the control bus 4, as well as connected to the light receiving portion 10 and arranged to sample an output from the light receiving portion 10 representing light received by the light receiving portion 10 and hold the same until the next light emission is performed; an A/D conversion circuit 12 connected between the sample and hold circuit 11 and the IF 9 and arranged to convert an output from the sample and hold circuit 11 from an analog signal to a digital signal; a timer 13 connected to the MPU 2 through an IF 14, the data bus 3 and the control bus 4 and arranged to generate timer interruption for causing the smoke detection operation to be performed; and a transmitting/receiving portion 15 connected to the MPU 2 through an IF 16, the data bus 3 and the control bus 4 and consisting of a parallel-to-serial conversion circuit, a transmitting circuit, a receiving circuit, a serial-to-parallel conversion circuit and the like (not shown) in order to transmit/receive information to and from an adjustment unit to be described later. The transmitting/receiving portion 15 transmits/receives information to and from a fire receiver or the like when the transmitting/receiving portion 15 is connected to the fire receiver or the like.

An adjustment unit 20 for adjusting the sensitivity comprises: an MPU 21 serving as a calculating means for performing a variety of calculating operations to be described later; a data bus 22 and a control bus 23 respectively connected to the MPU 21; a ROM 24 serving as a storage means connected to the MPU 21 through the data bus 22 and the control bus 23; and a RAM 25 serving as a storage means connected to the MPU 21 through the data bus 22 and the control bus 23. The ROM 24 has a program and the like relating to flow charts shown in FIGS. 8 and 9 to be described later, the common address, various constants and the like previously stored therein. The RAM 25 has a working area 251 for use when the MPU 21 performs the calculating operation and the like and a storage area 252 for temporarily storing data (for example, input address, a discrimination value, such as input fire discrimination threshold and the like) received from the fire detector 1 and data (for example, the common address, an address setting command, a fire threshold setting command, set address, setting fire threshold and the like) to be transmitted to the fire detector 1.

The adjustment unit 20 further comprises: a control portion 26 connected to the MPU 21 through an IF 27, the data bus 22 and the control bus 23 and injecting/removing a scattering and translucent plate to be described later to and from the optical portion of the fire detector 1; a printer 28 serving as an external storage means connected to the MPU 21 through an IF 29, the data bus 22 and the control bus 23 and arranged to transmit data and the like received from the fire detector 1; and a display portion 30 connected to the MPU 21 through an IF 31, the data bus 22 and the control bus 23 and consisting of, for example, a liquid crystal panel, a CRT, a count display tube, a display lamp or the like. As the printer 28, a floppy disk unit may be employed.

The adjustment unit 20 further comprises: an input portion 32 connected to the MPU 21 through an IF 33, the data bus 22 and the control bus 23 and provided with various switches for inputting the smoke density SD1 of the scattering and translucent plate and for performing other operations; and a transmitting/receiving portion 34 connected to the MPU 21 through an IF 35, the data bus 22 and the control bus 23, as well as connected to the transmitting/receiving portion 15 of the fire detector 1 and consisting of a parallel-to-serial conversion circuit, a transmitting circuit, a receiving circuit, a serial-to-parallel conversion circuit and the like (not shown) in order to transmit/receive information to and from the fire detector 1.

Figure 2A:
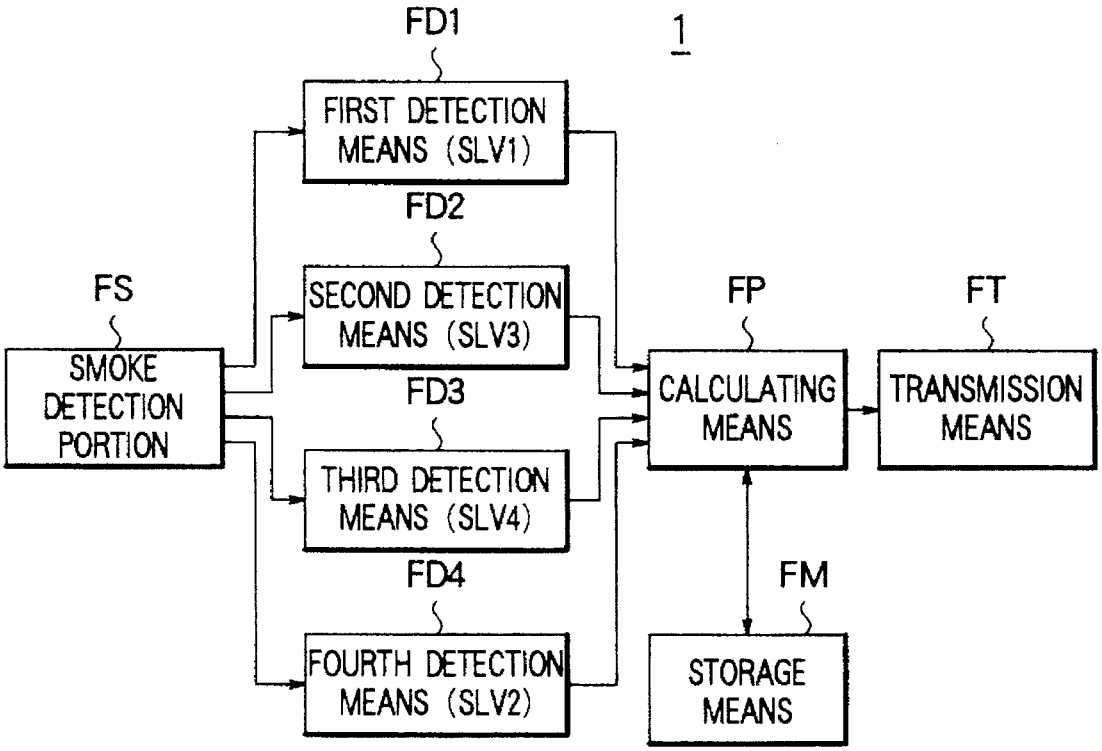
FIG. 2 has portions (a) and (b) which illustrate functions of the present invention.
Figure 2B:
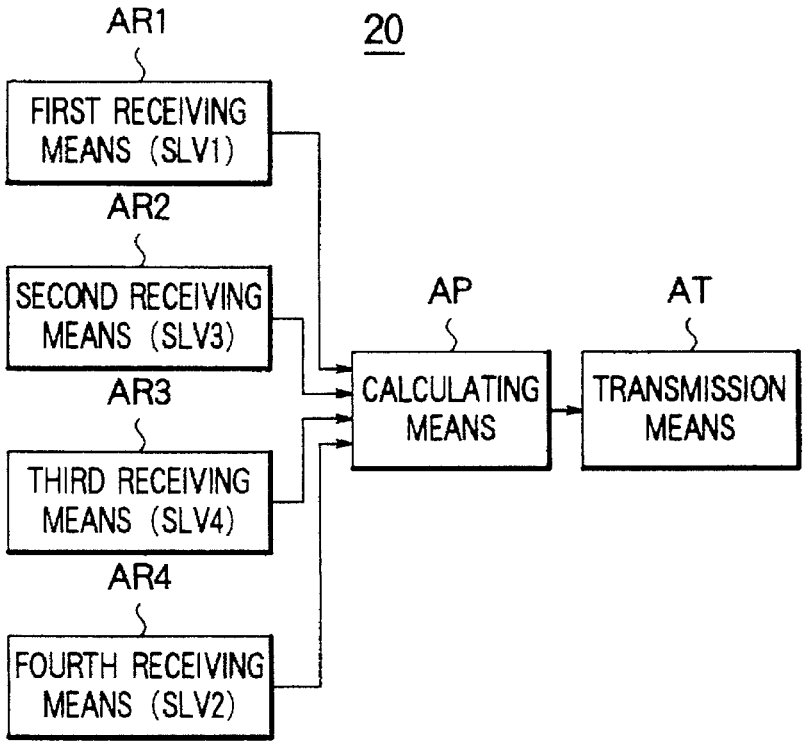

FIG. 2 is a block diagram which illustrates the function of the present invention, in which (a) of FIG. 2 shows the fire detector 1 and (b) of FIG. 2 shows the adjustment unit 20.

Referring to FIG. 2, the fire detector 1 comprises: a light scattering-type smoke detection portion FS having at least a light emitting device and a light receiving device; a first detection means FD1 for detecting the first received output (SLV1) of the light receiving device made when the light emitting device emits light in a state where the scattering and translucent plate is not inserted and no smoke is present; a second detection means FD2 for detecting the second received output (SLV3) of the light receiving device made when the light emitting device emits light in a state where the scattering and translucent plate is inserted and no smoke is present; a third detection means FD3 for detecting the third received output (SLV4) of the light receiving device made when the light emitting device does not emit light in a state where the scattering and translucent plate is inserted and no smoke is present; a fourth detection means FD4 for detecting the fourth received output (SLV2) of the light receiving device made when the light emitting device does not emit light in a state where the scattering and translucent plate is not inserted and no smoke is present; a calculating means FP for calculating the physical quantity of smoke with respect to the received output (SLVm) or the fire discrimination level (Ym) when the light emitting device emits light in the supervisory state in accordance with the first received output, the second received output and the smoke density (SD1) of the scattering and translucent plate when the second received output has been obtained; and an electrically rewritable storage means FM for storing the received output from each detection means and the smoke density of the scattering and translucent plate, as well as for storing received output obtained by subtracting the fourth received output from the first received output as the noise light component (ΔN) and for storing the received output obtained by subtracting the third received output from the second received output as reference signal light component (ΔSR); and transmission means FT for transmitting the first received output, the fourth received output and the like to the adjustment unit 20.

The calculating means FP calculates the physical quantity of smoke with respect to the received output (SLVm) of the light receiving device or the fire discrimination level when the light emitting device emits light in the fire supervisory state in accordance with the first received output, the second received output, the third received output and the smoke density (SD1) of the scattering and translucent plate when the second and third received output have been obtained.

The calculating means FP calculates the physical quantity of smoke with respect to the received output (SLVm) of the light receiving device or the fire discrimination level when the light emitting device emits light in the fire supervisory state in accordance with the first received output, the second received output, the third received output, the fourth received output and the smoke density (SD1) of the scattering and translucent plate when the second and third received output have been obtained.

The calculating means FP calculates the physical quantity of smoke with respect to the received output (SLVm) of the light receiving device or the fire discrimination level when the light emitting device emits light in the fire supervisory state in accordance with the fourth received output, the smoke density (SD1) of the scattering and translucent plate when the second and third received output have been obtained, the noise light component (ΔN) which is the received output obtained by subtracting the fourth received output from the first received output and reference signal light component (ΔSR) which is the received output obtained by subtracting the third received output from the second received output. The storage means FM stores the fire discrimination level (Ym) transmitted by the adjustment unit 20 or the physical quantity of smoke with respect to the received output (SLVm). The storage means FM may be provided for the calculating means FP.

The adjustment unit 20 comprises: a first receiving means AR1 for receiving the first received output (SLV1) of the light receiving device from the fire detector 1 when the light emitting device emits light in a state where the scattering and translucent plate is not inserted into the fire detector 1 and no smoke is present; a second receiving means AR2 for receiving the second received output (SLV3) of the light receiving device from the fire detector 1 when the light emitting device emits light in a state where the scattering and translucent plate is inserted into the fire detector 1 and no smoke is present; a third receiving means AR3 for receiving the third received output (SLV4) of the light receiving device from the fire detector 1 when the light emitting device does not emit light in a state where the scattering and translucent plate is inserted into the fire detector 1 and no smoke is present; a fourth receiving means AR4 for receiving the fourth received output (SLV2) of the light receiving device from the fire detector 1 when the light emitting device does not emit light in a state where the scattering and translucent plate is not inserted into the fire detector 1 and no smoke is present; a calculating means AP for calculating the physical quantity characteristics of the fire detector 1 between the received output (SLVm) and smoke or the fire discrimination level (Ym) in accordance with the first received output, the second received output and the smoke density of the scattering and translucent plate when the second received output has been obtained; and a transmission means AT for transmitting the physical quantity of the fire detector 1 between the received output (SLVm) and smoke obtained by the calculating means AP or the fire discrimination level (Ym) or the like to the adjustment unit 20.

The calculating means AP calculates the physical quantity of smoke with respect to the received output (SLVm) of the fire detector 1 or the fire discrimination level (Ym) in accordance with the first received output, the second received output, the third received output and the smoke density (SD1) of the scattering and translucent plate when the second and third received output have been obtained.

The calculating means AP calculates the physical quantity of smoke with respect to the received output (SLVm) of the fire detector 1 or the fire discrimination level (Ym) in accordance with the first received output, the second received output, the third received output, the fourth received output, and the smoke density (SD1) of the scattering and translucent plate when the second and third received output have been obtained.

The calculating means AP calculates the physical quantity of smoke with respect to the received output (SLVm) of the fire detector 1 or the fire discrimination level (Ym) in accordance with the fourth received output, the smoke density of the scattering and translucent plate when the second and third received output have been obtained, the noise light component (ΔN) which is the received output obtained by subtracting the fourth received output from the first received output and the reference signal light component (ΔSR) which is the received output obtained by subtracting the third received output from the second received output.

The smoke detection portion FS corresponds to the light emitting portion 8 and the light receiving portion 10 (both are shown in FIG. 1) of the fire detector 1, the first to fourth detection means FD1 to FD4 correspond to the sample and hold circuit 11 and the A/D conversion circuit 12 (both are shown in FIG. 1) of the fire detector 1, the calculating means FP corresponds to the MPU 2 (see FIG. 1) of the fire detector 1, the storage means FM corresponds to the EEPROM 6 (see FIG. 1) of the fire detector 1 and the transmission means FT corresponds to the transmitting/receiving portion 15 (see FIG. 1) of the fire detector 1.

The first to fourth receiving means AR1 to AR4 and transmission means AT correspond to the transmitting/receiving portion 34 (see FIG. 1) of the adjustment unit 20, and the calculating means AP corresponds to the MPU 21 (see FIG. 1) of the adjustment unit 20.

Figure 3:
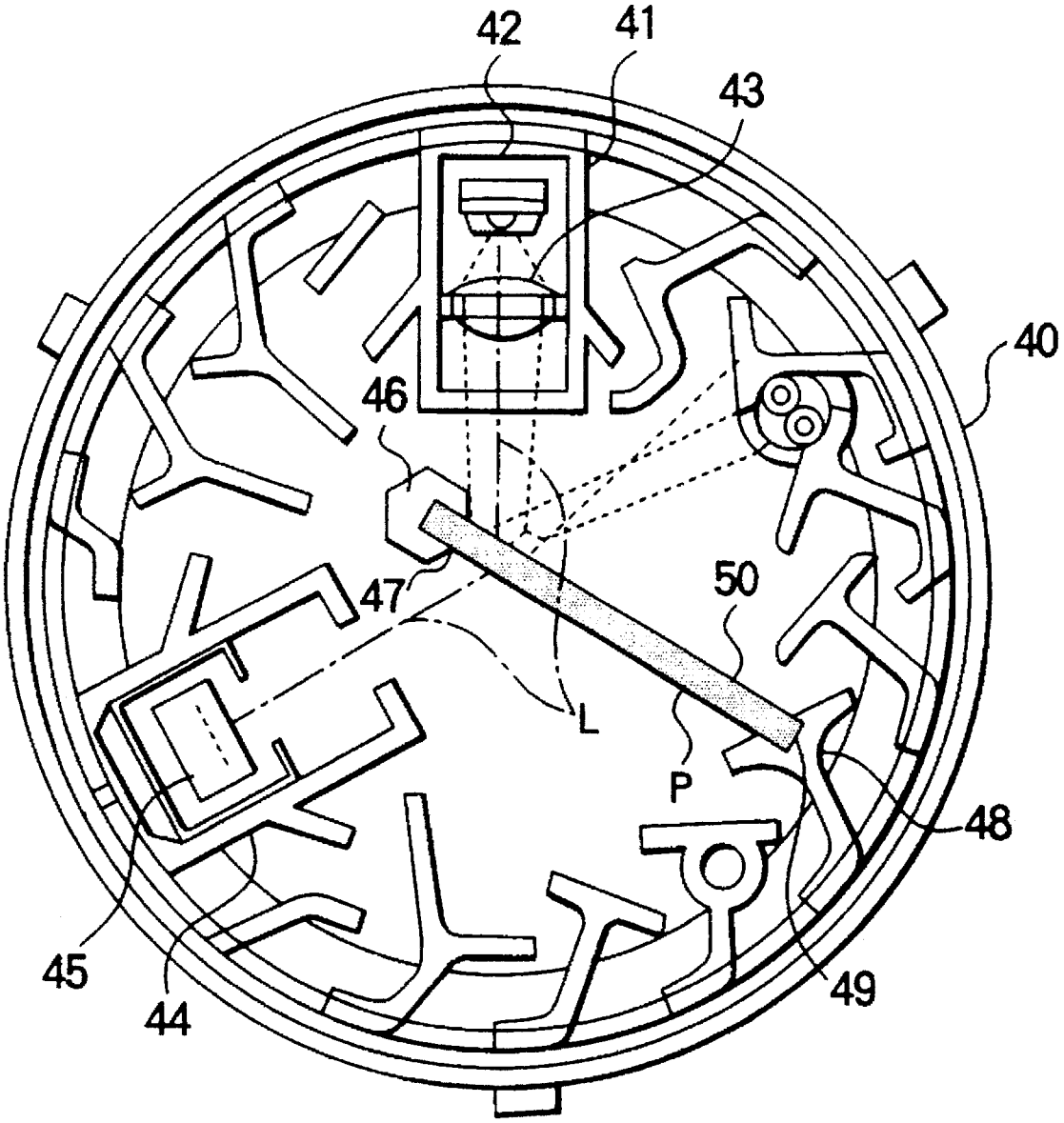
FIG. 3 illustrates a state where a scattering and translucent plate is inserted into an optical portion of the fire detector shown in FIG. 1.

FIG. 3 is a diagram which illustrates a state where the scattering and translucent plate is inserted into the optical portion of the fire detector 1. In a main body 40 of the fire detector 1, there are provided: an accommodating portion 41 for accommodating a light emitting device 42 and a lens 43 of the light emitting portion 8 (see FIG. 1); an accommodating portion 44 for accommodating a light receiving device 45 of the light receiving portion 10 (see FIG. 1); a light shield member 46 with an accommodating groove 47 disposed on an optical frame of the body 1; a labyrinth 48 with an accommodating groove 49 provided for the body 1 to face the light shield member 46; and a scattering and translucent plate 50 two ends of which are respectively inserted into the accommodating groves 47 and 49. The light shield member 46 protects the light receiving device 45 from direct introduction of light emitted by the light emitting device 42. The scattering and translucent plate 50 scatters light radiated by the light emitting device 42 in a state where smoke has been introduced into the black box, the scattering and translucent plate 50 having reflecting powder P, such as carbon particles mixed thereto.

The operation of this embodiment of the present invention will now be described with reference to FIGS. 4 to 10. Note that checking of the received signal by using the sum check code is omitted from description for the purpose of simply describing the operation.

Figure 4:
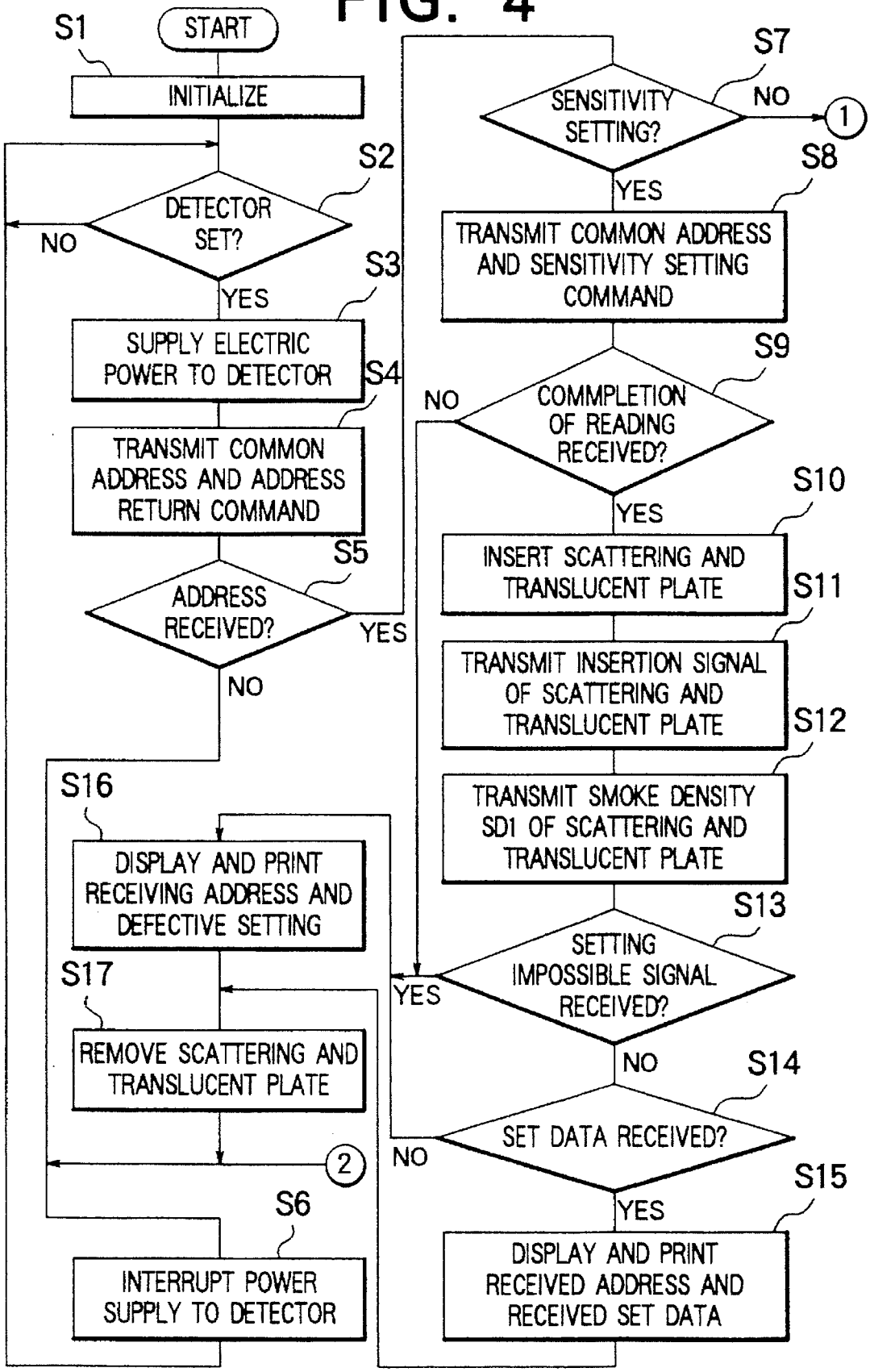
FIG. 4 is a flow chart for showing the operation of the setting unit shown in FIG. 1.

Initially, the operation of the adjustment unit 20 will now be described with reference to FIGS. 4 and 5. Note that all discrimination operations are performed by the MPU 21.

In step S1 the RAM 25 and the IFs 27, 29, 31, 33, 35 and the like are initialized. In step S2 whether or not the fire detector 1 has been set is discriminated. If the fire detector 1 has not been set, setting is waited for. If the fire detector 1 has been set, electric power is supplied to the fire detector 1 in step S3. In step S4 the common address and an address return command are transmitted to the fire detector 1 through the transmitting/receiving portion 34.

In step S5 whether or not set address (self-address) has been received from the fire detector 1 is discriminated. If the set address has not been received, supply of electric power to the fire detector 1 is interrupted in step S6.

If the set address is received in step S5, whether or not setting of the sensitivity is performed is discriminated in step S7. If the operation is setting of the sensitivity, the common address and the sensitivity setting command are transmitted to the fire detector 1 through the transmitting/receiving portion 34 in step S8.

In step S9 whether or not completion of reading of the received outputs SLV1 and SLV2 (step S54 shown in FIG. 7) in the fire detector 1 has been received is discriminated. If the completion of reading has been received, the control portion 26 causes the scattering and translucent plate 50 to be inserted between the light emitting device 42 and the light receiving device 45 in step S10. In step S11 an insertion signal representing insertion of the scattering and translucent plate 50 is transmitted to the fire detector 1 through the transmitting/receiving portion 34.

When the fire detector 1 receives the insertion signal representing the insertion of the scattering and translucent plate 50, the fire detector 1 starts performing the operation for calculating various set data items as described later. The insertion of the scattering and translucent plate 50 may be performed manually in place of automatic insertion performed by the control portion 26.

In step S12 the smoke density SD1 of the scattering and translucent plate 50 received from the input portion 32 is transmitted to the fire detector 1 through the transmitting/receiving portion 34. In step S13 whether or not setting impossible signal (step S56 shown in FIG. 7), representing the fact that the signal representing the insertion of the scattering and translucent plate 50 has not been received, has been received from the fire detector 1 is discriminated. If the signal has not been received, whether or not the foregoing set data has been received from the fire detector 1 is discriminated in step S14. If the same has been received, the received set address (the self-address) and the received set data are displayed on the display portion 30 in step S15, the displayed data being printed out by the printer 28 if necessary.

If the completion of reading of the received outputs SLV1 and SLV2 in the fire detector 1 is not received in step S9, or if the setting impossible signal has been received in step S13 or if the set data has not been received in step S14, the received set data (the selfaddress) and the impossibility of setting are, in step S16, displayed on the display portion 30 and printed out by the printer 28 if necessary.

If the operations in steps S15 and S16 have been completed, the control portion 26 causes the scattering and translucent plate 50 between the light emitting device 42 and the light receiving device 45 to be removed in step S17. Then, supply of electric power to the fire detector 1 is interrupted in step S6. Then, the operation returns to step S2 in which the foregoing operations are repeated.

Figure 5:
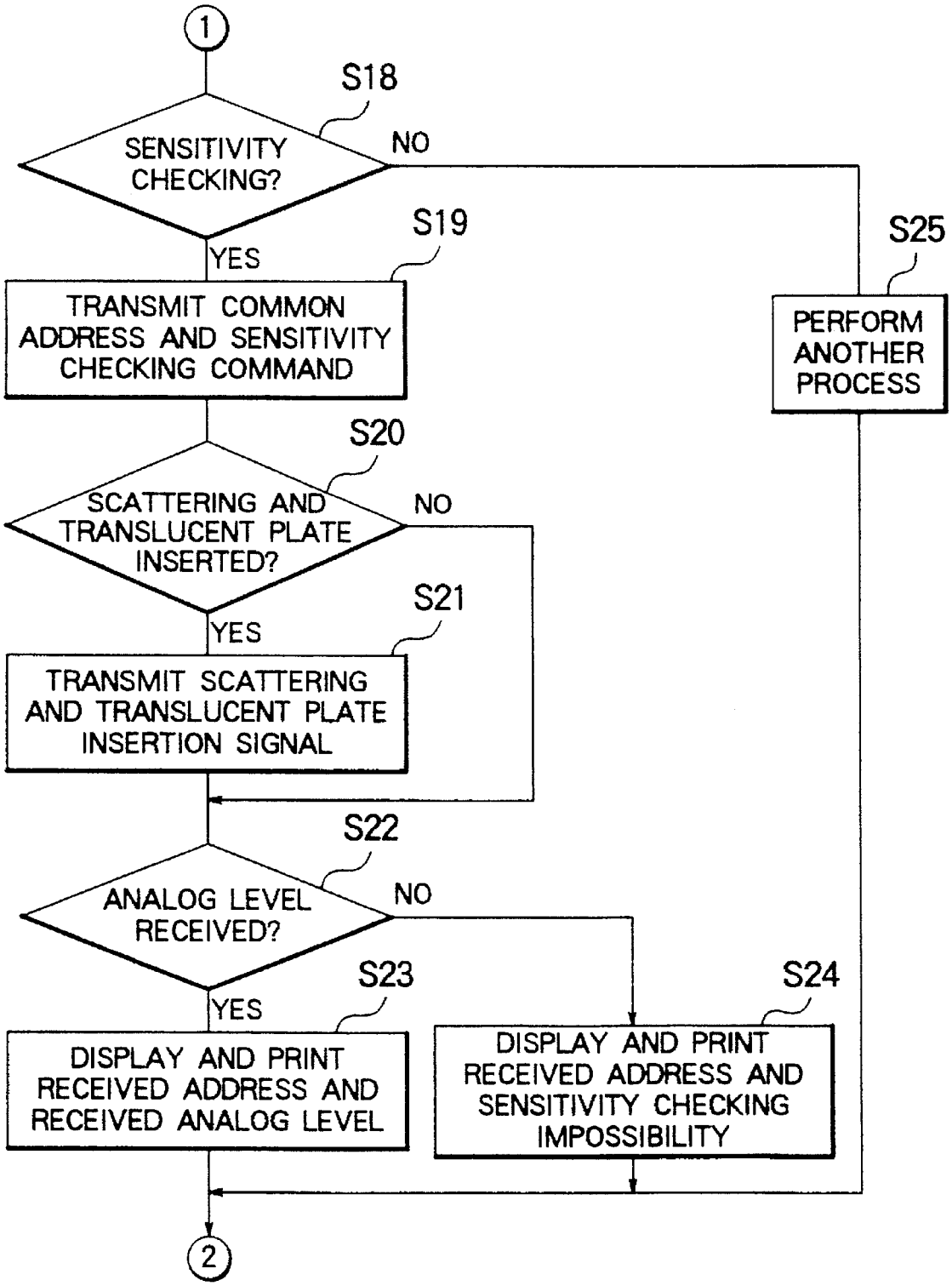
FIG. 5 is a flow chart for showing the operation of the setting unit shown in FIG. 1.

If the operation is not setting of the sensitivity in step S7, the operation proceeds to step S18 shown in FIG. 5 in which whether or not the operation is checking of the sensitivity is discriminated. If the operation is checking of the sensitivity, the command address and the sensitivity checking command are transmitted to the fire detector 1 through the transmitting/receiving portion 34 in step S19.

In step S20 whether or not the scattering and translucent plate 50 has been inserted is discriminated. If the scattering and translucent plate 50 has been inserted, the insertion signal, representing the fact that the scattering and translucent plate 50 is being inserted, is transmitted to the fire detector 1 through the transmitting/receiving portion 34 in step S21.

In step S22 whether or not the analog level (step S92 shown in FIG. 9) transmitted by the fire detector 1 has been received is discriminated. If the analog level has been received, the received set address (the self-address) and received analog level are displayed on the display portion 30 in step S23, and the same are printed out by the printer 28 if necessary. If the analog level transmitted by the fire detector 1 has not been received in step S22, the received set address (self-address) and impossibility of checking the sensitivity are displayed on the display portion 30 in step S24, and the same are printed out by the printer 28 if necessary.

If the operations in steps S23 and S24 have been completed, supply of power to the fire detector 1 is interrupted in step S6. Then, the operation returns to step S2 in which the foregoing operations are repeated.

If the operation is not checking of the sensitivity in step S18, another process is performed in step S25.

The operation of the fire detector 1 will now be described with reference to FIGS. 6 to 9. All discrimination operations in the following processes are performed by the MPU 2.

In step S31 RAM 7 and IFs 9, 14, 16 and the like are initialized. In step S32 whether or not a signal has been received from the adjustment unit 20 or a fire receiver (not shown) is discriminated. If the signal has not been received, whether or not timer interruption by the timer 13 has been made is discriminated in step S33. If the timer interruption has not been made, receipt of the signal or the timer interruption is waited for. If the timer interruption has been made, a smoke detection operation to be described later is performed in step S34. Then, the operation returns to step S32.

If the signal has been received in step S32, whether or not the received signal is the self-address, which is the call signal from the adjustment unit 20 or the fire receiver, is discriminated in step S35. If the signal is the self-address, a received command signal (for example, a type return command, a status information return command, a test command, a test result return command or the like) is decoded in step S36. Then, a process according to the received command is performed such that, if the command signal is the status information return command a process for transmitting the output representing the detected value (the physical quantity signal of the fire phenomenon or presence/absence of the fire signal) is performed. Then, the operation returns to step S32 in which the foregoing operations are repeated.

If the received signal is not the self-address in step S35, whether or not the received signal is the common address transmitted by the adjustment unit 20 or the fire receiver is discriminated in step S37. If the received signal is not the common address, the operation returns to step S32 in which the foregoing operations are repeated. If the received signal is the common address, whether or not the received signal is the command to set the sensitivity is discriminated in step S38. If the received signal is the command to set the sensitivity, the operation proceeds to step S39 in which a sensitivity setting process to be described later is performed.

If a discrimination has been made in step S38 that the received signal is not the command to set the sensitivity, whether or not the received signal is the sensitivity return command supplied from the adjustment unit 20 or the like is discriminated in step S40. If the received signal is the sensitivity return command, the received outputs SLV1 and SLV3, the noise (light) component $\Delta N$, the signal light component $\Delta SR$ and the smoke density SD1 of the scattering and translucent plate 50 are read from the EEPROM 6 in step S41, the received data being then transmitted to the adjustment unit 20 through the transmitting/receiving portion 15. If the received signal is not the sensitivity return command, whether or not the received signal is the sensitivity checking command is discriminated in step S42. If the received signal is not the sensitivity checking command, the operation proceeds to step S36 in which the foregoing operations are repeated. If the received signal is the sensitivity checking command, a sensitivity checking process to be described later is performed in step S43.

Figure 7:
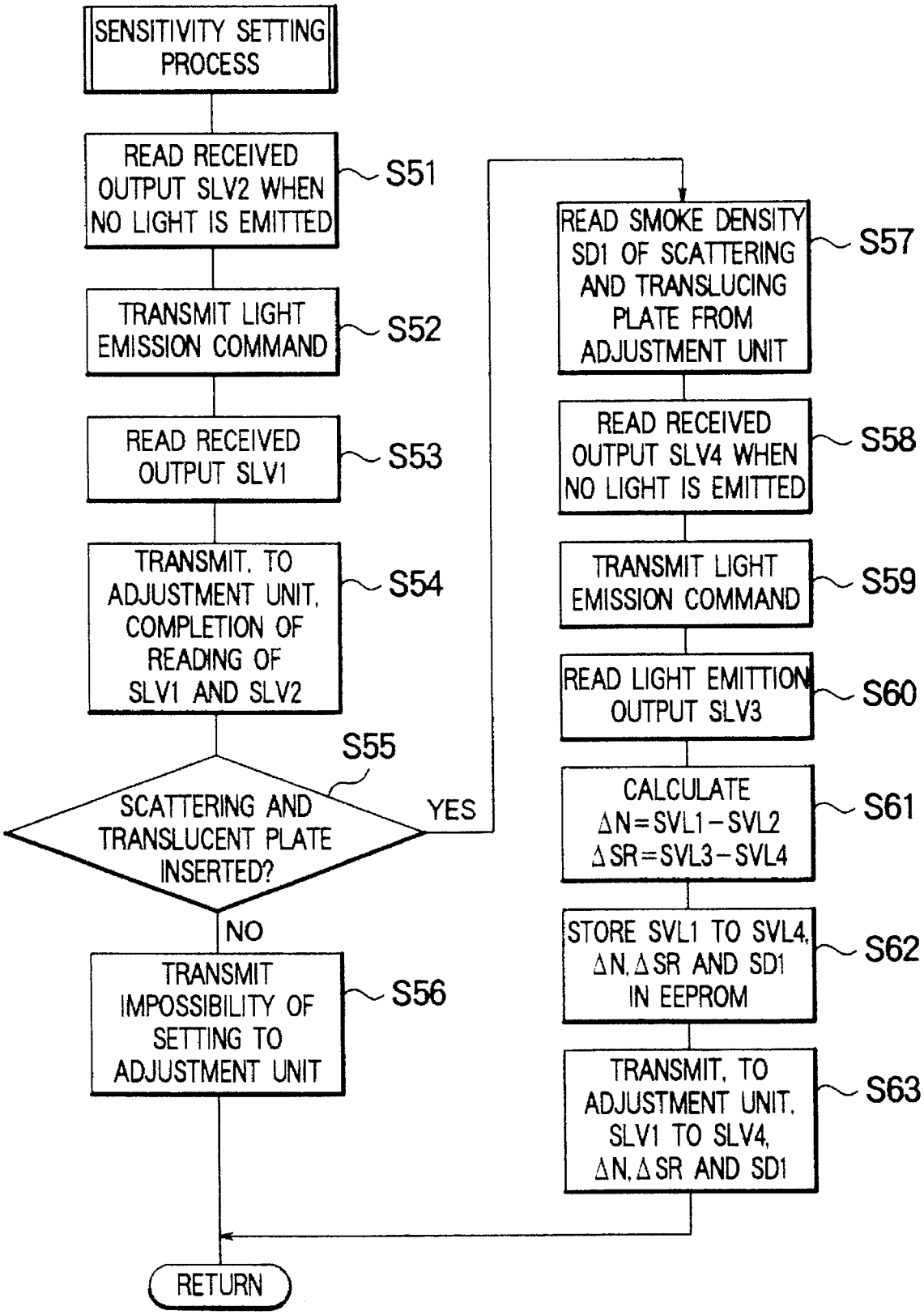
FIG. 7 is a flow chart for showing the operation of the fire detector shown in FIG. 1.

The sensitivity setting process to be performed in step S39 will now be described with reference to FIG. 7.

In step S51 the received output SLV2 received by the light receiving device 45 of the light receiving portion 10 realized when the light emitting device 42 of the light emitting portion 8 does not emit light in the state where the scattering and translucent plate 50 has not been inserted and as well as no smoke is present is temporarily read into the storage area 72 of the RAM 7. In step S52 a light emission command is supplied to the light emitting device 42 of the light emitting portion 8. In step S53 the received output of the light receiving device 45 of the light receiving portion 10, that is, the received output SLV1 received by the light receiving device 45 of the light receiving portion 10 realized when the light emitting device 42 of the light emitting portion 8 emits light in the state where the scattering and translucent plate 50 has not inserted and as well as no smoke is present is temporarily read into the storage area 72 of the RAM 7. In step S54 completion of reading of the received outputs SLV1 and SLV2 is transmitted to the adjustment unit 20 through the transmitting/receiving portion 15.

In step S55 whether or not the scattering and translucent plate 50 has been inserted, that is, whether or not the insertion signal of the scattering and translucent plate 50 has been received from the adjustment unit 20 in a predetermined time is discriminated. If the scattering and translucent plate 50 has not been inserted, a signal representing impossibility of setting is transmitted to the adjustment unit 20 through the transmitting/receiving portion 15.

If a discrimination has been made in step S55 that the scattering and translucent plate 50 has been inserted, the smoke density SD1 of the scattering and translucent plate 50 is read from the adjustment unit 20 in step S57. In step S58 the received output SLV4 received by the light receiving device 45 of the light receiving portion 10 when the light emitting device 42 of the light emitting portion 8 does not emit light in the state where the scattering and translucent plate 50 set to the smoke density SD1 has been inserted and as well as no smoke is present is temporarily read into the storage area 72 of the RAM 7. In step S59 a light emission command is transmitted to the light emitting device 42 of the light emitting portion 8. In step S60 the received output SLV3 received by the light receiving device 45 of the light receiving portion 10 when the light emitting device 42 of the light emitting portion 8 emits light in the state where the scattering and translucent plate 50 set to the smoke density SD1 has been inserted and as well as no smoke is present is temporarily read into the storage area 72 of the RAM 7.

In step S61 the noise (light) component ΔN (ΔN=SLV1−SLV2) and the signal light component ΔSR (ΔSR=SLV3−SLV4) are calculated and obtained. In step S62 the received outputs SLV1 to SLV4, the noise (light) component ΔN, the signal light component ΔSR and the smoke density SD1 are stored in the EEPROM 6. In step S63 the received outputs SLV1 to SLV4, the noise (light) component ΔN, the signal light component ΔSR and the smoke density SD1 are read from the EEPROM 6 and are transmitted to the adjustment unit 20 through the transmitting/receiving portion 15.

When the operations in the steps S56 and S63 have been completed, the operation returns to step S32.

The operations of the smoke detection process to be performed in step S34 will now be described with reference to FIG. 8.

In step S71 the received output SLV2 (the received output immediately before obtaining the received output SLVm when smoke, the density of which is Dx, has been introduced) received by the light receiving device 45 of the light receiving portion 10 when the light emitting device 42 of the light emitting portion 8 does not emit light in the fire supervisory state is temporarily read into the storage area 72 of the RAM 7. Then, a light emission command is transmitted to the light emitting device 42 of the light emitting portion 8. In step S72 the received output SLVm of the light receiving device 45 of the light receiving portion 10 realized when smoke the density of which is Dx has been introduced is read.

In step S73 the received output SLV (SLV=SLVm−SLV2) is calculated. In step S74 the signal light component ΔSM (ΔSM=SLV−ΔN) with respect to the received output SLVm made when smoke the density of which is ΔDx has been introduced in calculated. In step S75 the smoke density Dx (Dx=(SD1/ΔSR)×ΔSM) is calculated and obtained.

In step S76 the smoke density Dx is converted into an analog level, the analog level being stored at a predetermined position in the storage area 72 of the RAM 7. Then, the operation returns to step S32.

Figure 9:
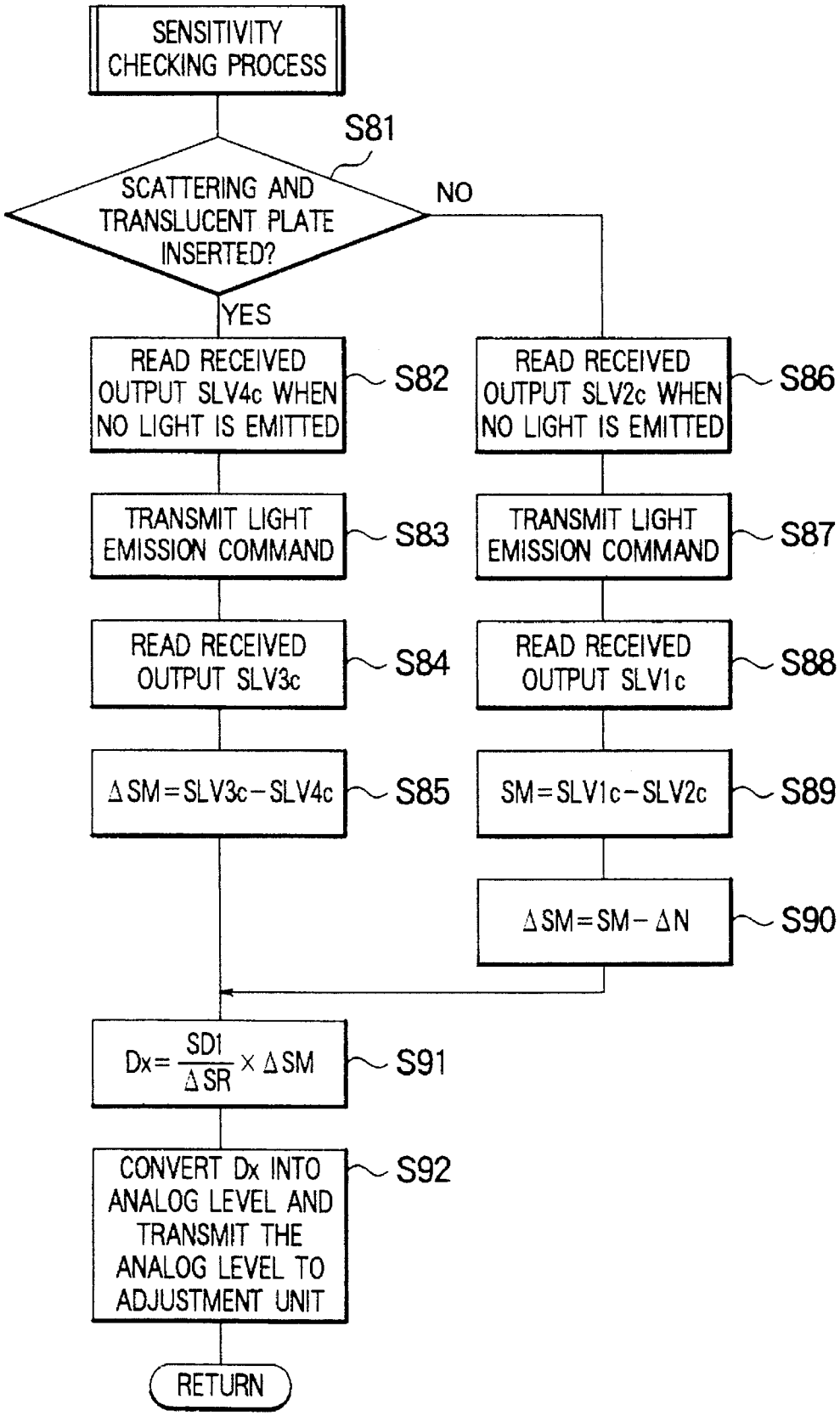
FIG. 9 is a flow chart for showing the operation of the fire detector shown in FIG. 1.

The operations of the sensitivity checking process to be performed in step S43 will now be described with reference to FIG. 9.

In step S81 whether or not the scattering and translucent plate 50 has been inserted, that is, the insertion signal representing insertion of the scattering and translucent plate 50 has been received from the adjustment unit 20, is discriminated. If the scattering and translucent plate 50 has been inserted, the received output SLV4c received by the light receiving device 45 of the light receiving portion 10 when the light emitting device 42 of the light emitting portion 8 does not emit light in the state where the scattering and translucent plate 50 has been inserted and as well as no smoke is present is temporarily read into the storage area 72 of the RAM 7 in step S82. In step S83 a light emission command is transmitted to the light emitting device 42 of the light emitting portion 8. In step S84 the received output of the light receiving device 45 of the light receiving portion 10, that is, the received output SLV3c received by the light receiving device 45 of the light receiving portion 10 when the light emitting device 42 of the light emitting portion 8 emits light in the state where the scattering and translucent plate 50 has been inserted and as well as no smoke is present is temporarily read into the storage area 72 of the RAM 7. In step S85 the signal light component ΔSM (ΔSM=SLV3c−SLV4c) is calculated and obtained.

If a discrimination has been made in step S81 that the scattering and translucent plate 50 has not been inserted, the received output SLV2c received by the light receiving device 45 of the light receiving portion 10 when the light emitting device 42 of the light emitting portion 8 does not emit light in the state where the scattering and translucent plate 50 has not been inserted and as well as no smoke is present is temporarily read into the storage area 72 of the RAM 7 in step S86. In step S87 a light emission command is transmitted to the light emitting device 42 of the light emitting portion 8. In step S88 the received output received by the light receiving device 45 of the light receiving portion 10, that is, the received output SLV1c received by the light receiving device 45 of the light receiving portion 10 when the light emitting device 42 of the light emitting portion 8 emits light in the state where the scattering and translucent plate 50 has not been inserted and as well as no smoke is present is temporarily read into the storage area 72 of the RAM 7.

In step S89 the signal light component SM (SM=SLV1c−SLV2c) is calculated. In step S90 a signal light component ΔSM (ΔSM=SM−ΔN) from which the noise light component has been removed is calculated.

In step S91 the smoke density Dx (Dx=(SD1/ΔSR)×ΔSM) is calculated. In step S92 the smoke density Dx is converted into an analog level. This analog level is transmitted to the adjustment unit 20 through the transmitting/receiving portion 15. Then, the operation returns to step S32.

Figure 10A:
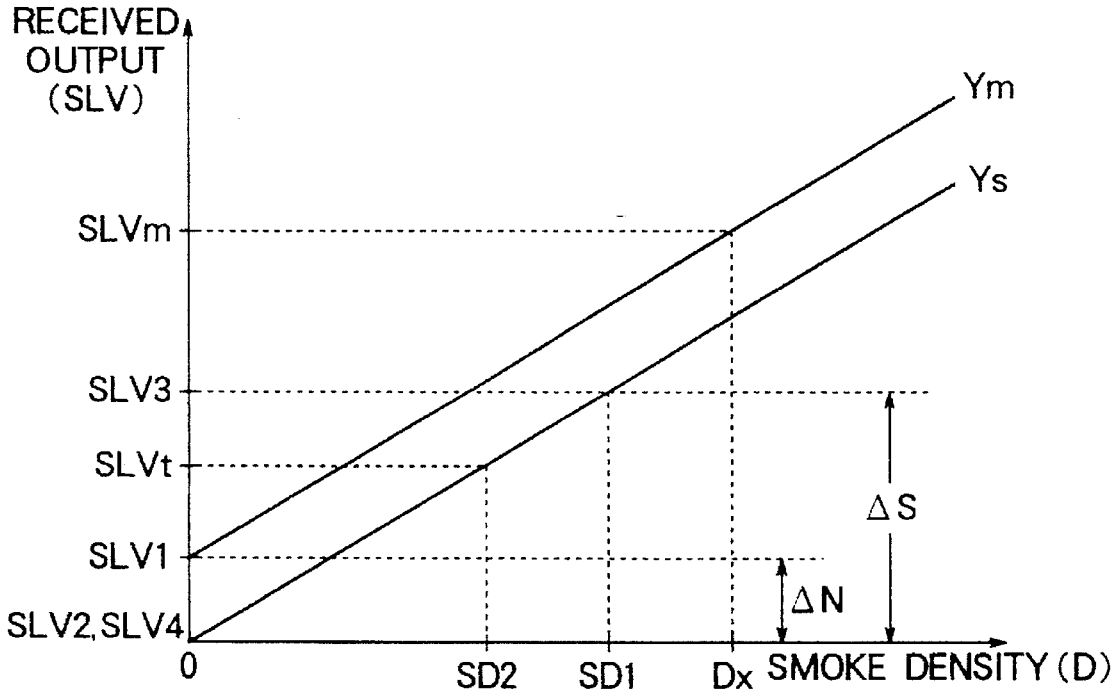
FIG. 10 has portions (a) and (b) which are graphs showing the relationship between the received output and the smoke density in a state where the sensitivity is set and a state where a fire is supervised according to the embodiment of the present invention.
Figure 10B:
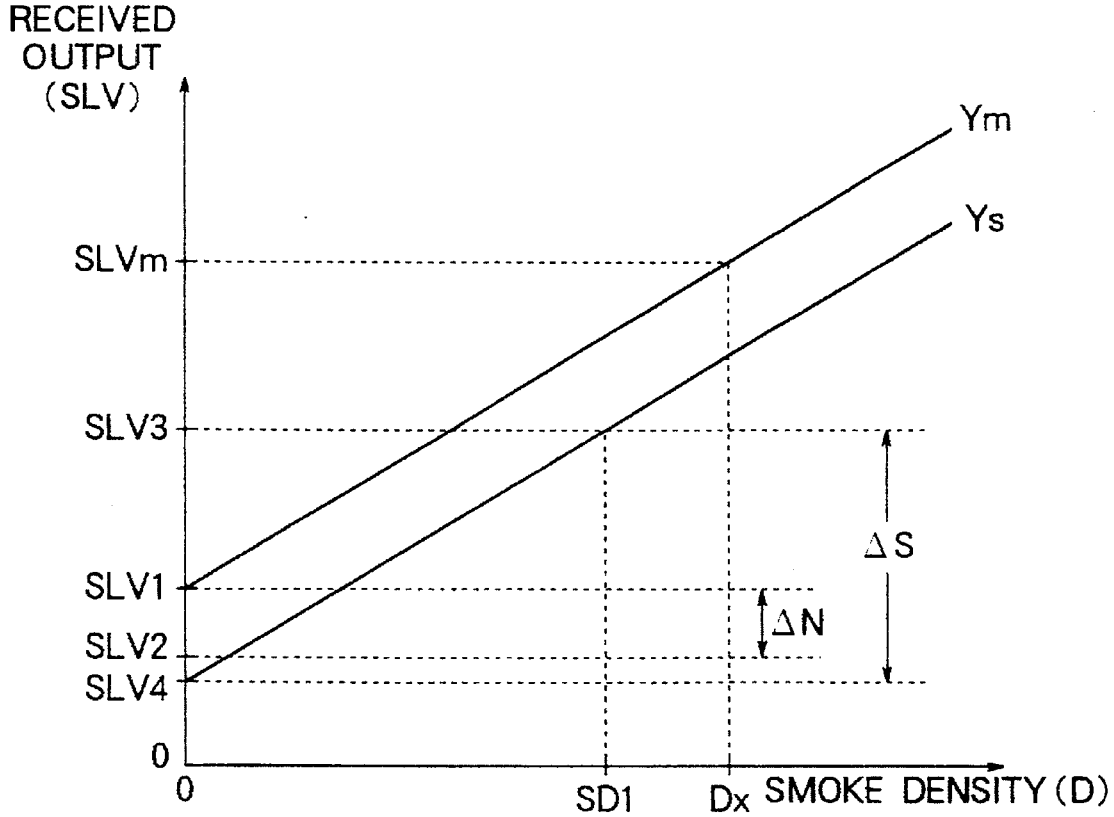

FIG. 10 is a graph showing the relationship between the received output SLV and the smoke density D in a state where the sensitivity is set and a state where the fire is supervised. Portion (a) of FIG. 10 shows the physical quantity characteristics of the received output and smoke in a case influence of the offset of the amplifying circuit included in the light receiving portion 10 and that of the received output undergoing due to light that has passed through the wall of the optical chamber (not shown) in which the light emitting portion 8 and the light receiving portion 10 are accommodated and the labyrinth and therefore is not shielded is ignored. Portion (b) of FIG. 10 shows the foregoing relationship in a case where the influence of the offset and the like are considered.

Referring to portion (a) of FIG. 10, an assumption is made such that the characteristic realized when the scattering and translucent plate 50 set to a smoke density of Dx has been inserted is Ys. Thus, the characteristic Ys is expressed by the following equation:

$$Ys=(SLV3\div SD1)\times Dx \quad (1)$$

As contrasted with this, an assumption is made such that the characteristic realized when smoke the density of which is Dx has been introduced in the fire supervisory state is Ym. Thus, the characteristic Ym is expressed by the following equation:

$$Ym=(SLV3\div SD1)\times Dx+SLV1 \quad (2)$$

Therefore, when the fire discrimination level is set, a predetermined smoke density, which is determined to be the fire discrimination level, is substituted into the smoke density Dx, thus resulting in that the characteristic Ym is the fire discrimination level.

The signal light component ΔS with respect to the received output SLVm realized when smoke the density of which is Dm has been introduced is expressed by the following equation:

$$\Delta S = SLVm - SLV1 = (SLV3 + SD1) \times Dm \quad (3)$$

Therefore, the smoke density (the physical quantity signal of smoke) Dm corresponding to the received output SLVm can be obtained from the following equation:

$$\begin{aligned} Dm &= (SD1 \div SLV3) \times \Delta S \\ &= (SD1 \div SLV3) \times (SLVm - SLV1) \end{aligned} \quad (4)$$

The signal light component AS with respect to the received output SLVt realized when the scattering and translucent plate 50 set to the smoke density SD2 has been inserted to check the sensitivity is expressed by the following equation:

$$\Delta S = SLVt \quad (5)$$

Therefore, the smoke density SD2 can be obtained from the following equation:

$$SD2 = (SD1 \div SLV3) \times SLVt \quad (6)$$

Thus, in the case where the offset of the amplifying circuit and the like are ignored, use of SLV1 (=ΔN), SLV3 and SD1 corresponding to SLV3, that is, previous storage of the foregoing factors in the EEPROM 6, enables the fire discrimination level to be obtained or the smoke density (analog value=physical quantity) to be detected from the received output at the time of supervising a fire or checking the sensitivity. In the case where the offset of the amplifying circuit and the like are considered in the state shown in portion (b) of FIG. 10, the characteristics Ys and Ym are expressed by the following equations:

$$Ys = \{(SLV3 - SLV4) \div SD1)\} \times Dx + SLV4 \quad (7)$$

$$Ym = \{(SLV3 - SLV4) \div SD1)\} \times Dx + SLV1 \quad (8)$$

As a result, similarly to the foregoing process, substitution of a predetermined smoke density, which is determined to be the fire discrimination level, into the smoke density Dx of equation (8) will cause the thus-obtained characteristic Ym to be the fire discrimination level.

The signal light component ΔS with respect to the received output SLVm realized when smoke the density of which is Dm has been introduced is expressed by the following equation:

$$SLVm0 = SLVm - SLV2 \quad (9)$$

Figure 8:
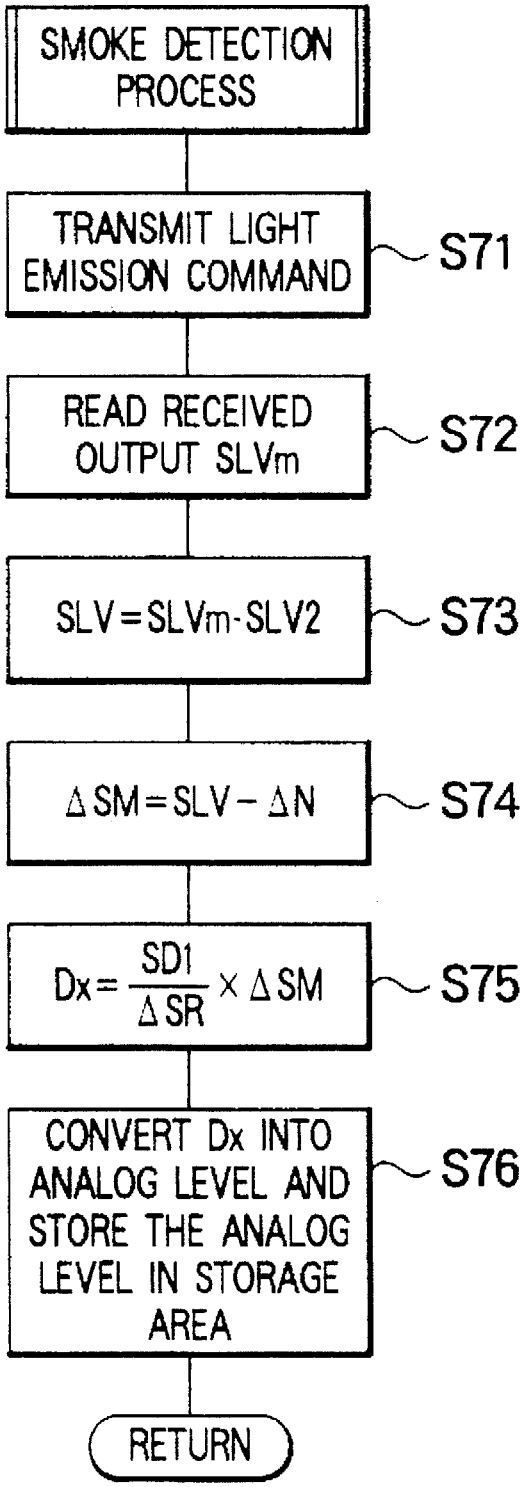
FIG. 8 is a flow chart for showing the operation of the fire detector shown in FIG. 1.

Note that the received output SLVm0 in equation (9) is the received output obtained by subtracting the degree of the offset of the amplifying circuit from the received output SLVm, the received output SLVmO corresponding to the received output SLV in step S73 (see FIG. 8).

Therefore, the signal light component ΔSM from which the noise light component has been removed is expressed by the following equation:

$$\Delta SM = SLVm0 - \Delta N \quad (10)$$

Note that equation ΔN=SLV1−SLV2 is satisfied in equation (10).

Hence, the smoke density (the physical quantity signal of smoke) Dm corresponding to the received output SLVm can be obtained from the following equation if the reference signal light component ΔSR is assumed to be ΔSR= SLV3−SLV4:

$$\begin{aligned} Dm &= (SD1 \div \Delta SR) \times \Delta SM \\ &= (SD1 \div \Delta SR) \times (SLVm - SLV2 - \Delta N) \end{aligned} \quad (11)$$

As a result of this, if the offset of the amplifying circuit and the like are considered, use of SLV1, SLV2, SLV3, SLV4, SD1 corresponding to SLV3 and SLV4 or ΔN, ΔSR and SD1, that is, previous storage of the foregoing data in the EEPROM 6, will enable the fire discrimination level to be obtained and the smoke density (the analog value=the physical quantity) to be detected from the received output when a fire is supervised or the sensitivity is checked.

Note that equation (11) can be deformed as follows:

$$Dm = (SD1 \div \Delta SR) \times (SLVm - SLV1) \quad (12)$$

Therefore, previous storage of SLV1, SLV3, SLV4, SD1 corresponding to SLV3 and SLV4, or SLV1, ΔSR and SD1 in the EEPROM 6 will enable the fire discrimination level to be obtained and the smoke density to be obtained from the received output similarly to the foregoing process.

As described above, this embodiment has the arrangement that fire discrimination level of the photoelectric type fire detector or the characteristics of the analog output with respect to the detected output of the light receiving device are obtained in such a manner that the received output obtained realized when the scattering and translucent plate has not inserted into the photoelectric type fire detector and light is emitted, that is, the noise light component is added to the received output obtained when the scattering and translucent plate has been inserted into the photoelectric type fire detector and light is emitted, that is, to the signal light component. Therefore, influence of dispersion among black boxes and slight difference in the positions, at which the light emitting device and the light receiving device are attached undergoing with each of a plurality of photoelectric type fire detectors can be eliminated. Thus, the sensitivity can always and accurately be set.

Although the foregoing embodiment has been described which has the arrangement that the sensitivity setting process (see FIG. 7) is performed when the common address and the sensitivity setting command have been received from the adjustment unit, the data stored in the EEPROM is transmitted when the common address and the sensitivity return command have been received and the sensitivity is checked when the common address and the sensitivity checking command have been received, the present invention is not limited to this. For example, each process may be performed when another process is performed, for example, when only the sensitivity setting command, the sensitivity return command or the sensitivity checking command has been received or when the self-address has been received.

Data to be stored in the EEPROM may be at least three data items consisting of the received output SLV1, SLV4 and the smoke density SD1 of the scattering and translucent plate, or the fire discrimination level FL (in the case where the fire detector is the normal type detector) or one or a plurality of collation data (in the case where the fire detector is the analog detector) between the detected output and the analog level for obtaining the analog level from the detected output.

In a case where the fire discrimination level FL (in the case where the fire detector is the normal type detector) or the one or the plural collation data between the detected output and the analog level are not stored in the EEPROM, the received outputs SLV1, SLV2, SLV3, SLV4 stored in the EEPROM and the smoke density SD1 or the received output SLV1, SLV4 and the smoke density SD1 may be used, and the fire discrimination level may be obtained by calculations or the physical quantity of smoke may be obtained from the received output when a fire is supervised.

Although the foregoing embodiment has the arrangement that the fire detector performs calculations required in the sensitivity setting operation, the calculations may be performed by the adjustment unit. The results of the calculations is, in this case, transmitted to the fire detector to be stored in the EEPROM.

In the foregoing case, the fire detector transmits the received outputs SLV1, SLV2, SLV3 and SLV4 to the adjustment unit whenever the fire detector reads the foregoing received outputs. When the adjustment unit has, from the fire detector, collected data required to set the sensitivity, the adjustment unit makes a fire discrimination level (in the case where the fire detector is the normal-type detector) for the fire detector by using the collected data or makes one or a plurality of collation data (in the case where the fire detector is the analog detector) for obtaining the analog level from the output denoting the result of the detection to transmit the fire discrimination level or the collation data to the fire detector. When the fire detector has received the data, the fire detector writes the received data on the EEPROM. If former data is present, it is erased before the received data is written.

Although the foregoing embodiment has been described which has the arrangement that each of the received outputs SLV1 to SVL4 is read one time at the time of setting the sensitivity, the received outputs SLV1 to SLV4 may be read plural times to cause their average value, or an average value of data having lesser deviation or their intermediate values as received outputs SLV1 to SLV4 to be stored in the EEPROM. Note that reading of the received outputs SLV1c to SLV4c at the time of checking the sensitivity is performed similarly.

As a result of the foregoing arrangement, even if the received outputs are temporarily affected by, for example, induced noise at the time of performing the sensitivity setting process or the sensitivity checking process, the influence can be eliminated.

What is claimed is:

1. A photoelectric type fire detector having a light-scattering-type smoke detection portion including a light emitting device and a light receiving device, arranged to transmit a physical quantity signal of smoke in accordance with an output from said smoke detection portion representing received light and as well as to adjust the sensitivity by using a scattering and translucent plate, said photoelectric type fire detector comprising:

first detection means for detecting a first received output from said smoke detection portion realized when said light emitting device emits light in a case where said scattering and translucent plate is not inserted and as well as no smoke is present;

second detection means for detecting a second received output from said smoke detection portion realized when said light emitting device emits light in a case where said scattering and translucent plate is inserted and as well as no smoke is present; and calculating means for calculating said physical quantity of smoke with respect to said received output from said smoke detection portion realized when said light emitting device emits light in a state where a fire is supervised based on said first received output, said second received output and a smoke density of said scattering and translucent plate realized when said second received output has been obtained, wherein the sensitivity is adjusted in accordance with an output from said calculating means.

2. A photoelectric type fire detector according to claim 1 further comprising storage means for storing said first received output, said second received output and smoke density of said scattering and translucent plate realized when said second received output has been obtained.

3. A photoelectric type fire detector according to claim 1 wherein said calculating means comprises storage means for storing said first received output, said second received output and smoke density of said scattering and translucent plate realized when said second received output has been obtained.

4. A photoelectric type fire detector having a light-scattering-type smoke detection portion including a light emitting device and a light receiving device, arranged to transmit a physical quantity signal of smoke in accordance with an output from said smoke detection portion representing received light and as well as to adjust the sensitivity by using a scattering and translucent plate, said photoelectric type fire detector comprising:

first detection means for detecting a first received output from said smoke detection portion realized when said light emitting device emits light in a case where said scattering and translucent plate is not inserted and as well as no smoke is present;

second detection means for detecting a second received output from said smoke detection portion realized when said light emitting device emits light in a case where said scattering and translucent plate is inserted and as well as no smoke is present;

third detection means for detecting a third received output from said smoke detection portion realized when said light emitting device does not emit light in a case where said scattering and translucent plate is inserted and as well as no smoke is present; and calculating means for calculating said physical quantity of smoke with respect to said received output from said smoke detection portion realized when said light emitting device emits light in a state where a fire is supervised based on said first received output, said second received output, said third received output and smoke density of said scattering and translucent plate realized when said second received output and said third received output have been obtained, wherein the sensitivity is adjusted in accordance with an output from said calculating means.

5. A photoelectric type fire detector according to claim 4 further comprising storage means for storing said first received output and the smoke density of said scattering and translucent plate realized when said second received output and said third received output have been obtained and as well as storing, as a reference signal light component, a received output obtained by subtracting said third received output from said second received output.

6. A photoelectric type fire detector according to claim 4 wherein said calculating means comprises storage means for storing said first received output and the smoke density of said scattering and translucent plate realized when said second received output and said third received output have been obtained and as well as storing, as a reference signal light component, a received output obtained by subtracting said third received output from said second received output.

7. A photoelectric type fire detector having a light-scattering-type smoke detection portion including a light emitting device and a light receiving device, arranged to transmit a physical quantity signal of smoke in accordance with an output from said smoke detection portion representing received light and as well as to adjust the sensitivity by using a scattering and translucent plate, said photoelectric type fire detector comprising:

first detection means for detecting a first received output from said smoke detection portion realized when said light emitting device emits light in a case where said scattering and translucent plate is not inserted and as well as no smoke is present;

second detection means for detecting a second received output from said smoke detection portion realized when said light emitting device emits light in a case where said scattering and translucent plate is inserted and as well as no smoke is present;

third detection means for detecting a third received output from said smoke detection portion realized when said light emitting device does not emit light in a case where said scattering and translucent plate is inserted and as well as no smoke is present;

fourth detection means for detecting a fourth received output from said smoke detection portion realized when said light emitting device does not emit light in a case where said scattering and translucent plate is not inserted and as well as no smoke is present; and calculating means for calculating said physical quantity of smoke with respect to said received output from said smoke detection portion realized when said light emitting device emits light in a state where a fire is supervised based on said first received output, said second received output, said third received output, said fourth received output and a smoke density of said scattering and translucent plate realized when said second received output and said third received output have been obtained, wherein the sensitivity is adjusted in accordance with an output from said calculating means.

8. A photoelectric type fire detector according to claim 7 further comprising storage means for storing said fourth received output and the smoke density of said scattering and translucent plate realized when said second received output and said third received output have been obtained, for storing, as a noise light component, a received output obtained by subtracting said fourth received output from said first received output and for storing, as a reference signal light component, a received output obtained by subtracting said third received output from said second received output.

9. A photoelectric type fire detector according to claim 7 wherein said calculating means comprises storage means for storing said fourth received output and the smoke density of said scattering and translucent plate realized when said second received output and said third received output have been obtained, for storing, as a noise light component, a received output obtained by subtracting said fourth received output from said first received output and for storing, as a reference signal light component, a received output obtained by subtracting said third received output from said second received output.

10. A photoelectric type fire detector having a light-scattering-type smoke detection portion including a light emitting device and a light receiving device, arranged to subject a received output obtained from said smoke detection portion to a comparison with a fire discrimination level to discriminate whether or not a fire has started and as well as to adjust sensitivity by using a scattering and translucent plate, said photoelectric type fire detector comprising:

first detection means for detecting a first received output from said smoke detection portion realized when said light emitting device emits light in a case where said scattering and translucent plate is not inserted and as well as no smoke is present;

second detection means for detecting a second received output from said smoke detection portion realized when said light emitting device emits light in a case where said scattering and translucent plate is inserted and as well as no smoke is present; and calculating means for calculating a fire discrimination level based on said first received output, said second received output and a smoke density of said scattering and translucent plate realized when said second received output has been obtained, wherein the sensitivity is adjusted in accordance with an output from said calculating means.

11. A photoelectric type fire detector according to claim 10 further comprising storage means for storing said first received output, said second received output and the smoke density of said scattering and translucent plate realized when said second received output has been obtained.

12. A photoelectric type fire detector according to claim 10 wherein said calculating means comprises storage means for storing said first received output, said second received output and the smoke density of said scattering and translucent plate realized when said second received output has been obtained.

13. A photoelectric type fire detector having a light-scattering-type smoke detection portion including a light emitting device and a light receiving device, arranged to subject a received output obtained from said smoke detection portion to a comparison with a fire discrimination level to discriminate whether or not a fire has started and as well as to adjust sensitivity by using a scattering and translucent plate, said photoelectric type fire detector comprising:

first detection means for detecting a first received output from said smoke detection portion realized when said light emitting device emits light in a case where said scattering and translucent plate is not inserted and as well as no smoke is present;

second detection means for detecting a second received output from said smoke detection portion realized when said light emitting device emits light in a case where said scattering and translucent plate is inserted and as well as no smoke is present;

third detection means for detecting a third received output from said smoke detection portion realized when said light emitting device does not emit light in a case where said scattering and translucent plate is inserted and as well as no smoke is present; and calculating means for calculating a fire discrimination level based on said first received output, said second received output, said third received output and a smoke density of said scattering and translucent plate realized when said second received output and said third received output have been obtained, wherein the sensitivity is adjusted in accordance with an output from said calculating means.

14. A photoelectric type fire detector according to claim 13 further comprising storage means for storing said first received output and the smoke density of said scattering and translucent plate realized when said second received output and said third received output have been obtained and as well as storing, as a reference signal light component, a received output obtained by subtracting said third received output from said second received output.

15. A photoelectric type fire detector according to claim 13 wherein said calculating means comprises storage means for storing said first received output and the smoke density of said scattering and translucent plate realized when said second received output and said third received output have been obtained and as well as storing, as a reference signal light component, a received output obtained by subtracting said third received output from said second received output.

16. A photoelectric type fire detector having a light-scattering-type smoke detection portion including a light emitting device and a light receiving device, arranged to subject a received output obtained from said smoke detection portion to a comparison with a fire discrimination level to discriminate whether or not a fire has started and as well as to adjust sensitivity by using a scattering and translucent plate, said photoelectric type fire detector comprising:

first detection means for detecting a first received output from said smoke detection portion realized when said light emitting device emits light in a case where said scattering and translucent plate is not inserted and as well as no smoke is present;

second detection means for detecting a second received output from said smoke detection portion realized when said light emitting device emits light in a case where said scattering and translucent plate is inserted and as well as no smoke is present;

third detection means for detecting a third received output from said smoke detection portion realized when said light emitting device does not emit light in a case where said scattering and translucent plate is inserted and as well as no smoke is present;

fourth detection means for detecting a fourth received output from said smoke detection portion realized when said light emitting device does not emit light in a case where said scattering and translucent plate is not inserted and as well as no smoke is present; and calculating means for calculating the fire discrimination level based on said first received output, said second received output, said third received output, said fourth received output and the smoke density of said scattering and translucent plate realized when said second received output and said third received output have been obtained, wherein the sensitivity is adjusted in accordance with an output from said calculating means.

17. A photoelectric type fire detector according to claim 16 further comprising storage means for storing said fourth received output and the smoke density of said scattering and translucent plate realized when said second received output and said third received output have been obtained, for storing, as a noise light component, a received output obtained by subtracting said fourth received output from said first received output and for storing, as a reference signal light component, a received output obtained by subtracting said third received output from said second received output.

18. A photoelectric type fire detector according to claim 16 wherein said calculating means comprises storage means for storing said fourth received output and the smoke density of said scattering and translucent plate realized when said second received output and said third received output have been obtained, for storing, as a noise light component, a received output obtained by subtracting said fourth received output from said first received output and for storing, as a reference signal light component, a received output obtained by subtracting said third received output from said second received output.

19. A photoelectric type fire detector having a light-scattering-type smoke detection portion including a light emitting device and a light receiving device, arranged to transmit a physical quantity signal of smoke in accordance with an output from said smoke detection portion representing received light and as well as to adjust the sensitivity by using a scattering and translucent plate, said photoelectric type fire detector comprising:

first detection means for detecting a first received output from said smoke detection portion realized when said light emitting device emits light in a case where said scattering and translucent plate is not inserted and as well as no smoke is present;

second detection means for detecting a second received output from said smoke detection portion realized when said light emitting device emits light in a case where said scattering and translucent plate is inserted and as well as no smoke is present;

third detection means for detecting a third received output from said smoke detection portion realized when said light emitting device does not emit light in a case where said scattering and translucent plate is inserted and as well as no smoke is present;

fourth detection means for detecting a fourth received output from said smoke detection portion realized when said light emitting device does not emit light in a case where said scattering and translucent plate is not inserted and as well as no smoke is present;

storage means for storing said fourth received output and a smoke density of said scattering and translucent plate realized when said second received output and said third received output have been obtained, for storing, as a noise light component, a received output obtained by subtracting said fourth received output from said first received output and for storing, as a reference signal light component, a received output obtained by subtracting said third received output from said second received output; and calculating means for calculating said physical quantity of smoke with respect to a received output from said smoke detection portion realized when said light emitting device emits light in a state where a fire is supervised based on said fourth received output, the smoke density of said scattering and translucent plate, said noise light component and said reference signal light component, wherein the sensitivity is adjusted in accordance with an output from said calculating means.

20. A photoelectric type fire detector having a light-scattering-type smoke detection portion including a light emitting device and a light receiving device, arranged to subject a received output obtained from said smoke detection portion to a comparison with a fire discrimination level to discriminate whether or not a fire has started and as well as to adjust sensitivity by using a scattering and translucent plate, said photoelectric type fire detector comprising:

first detection means for detecting a first received output from said smoke detection portion realized when said light emitting device emits light in a case where said scattering and translucent plate is not inserted and as well as no smoke is present;

second detection means for detecting a second received output from said smoke detection portion realized when said light emitting device emits light in a case where said scattering and translucent plate is inserted and as well as no smoke is present;

third detection means for detecting a third received output from said smoke detection portion realized when said light emitting device does not emit light in a case where said scattering and translucent plate is inserted and as well as no smoke is present;

fourth detection means for detecting a fourth received output from said smoke detection portion realized when said light emitting device does not emit light in a case where said scattering and translucent plate is not inserted and as well as no smoke is present;

storage means for storing said fourth received output and a smoke density of said scattering and translucent plate realized when said second received output and said third received output have been obtained, for storing, as a noise light component, a received output obtained by subtracting said fourth received output from said first received output and for storing, as a reference signal light component, a received output obtained by subtracting said third received output from said second received output; and calculating means for calculating the fire discrimination level based on said fourth received output, the smoke density of said scattering and translucent plate, said noise light component and said reference signal light component, wherein the sensitivity is adjusted in accordance with an output from said calculating means.

21. An adjustment apparatus comprising: a photoelectric type fire detector for transmitting a fire signal in accordance with a received output from a smoke detection portion including a light emitting device and a light receiving device when a physical quantity signal of smoke has been transmitted or when the received output from said smoke detection portion has reached a fire discrimination level; and an adjustment unit for adjusting sensitivity of said photoelectric type fire detector by using a scattering and translucent plate, wherein said adjustment unit comprises:

first receiving means for receiving a first received output from said smoke detection portion realized when said light emitting device emits light in a case where said scattering and translucent plate is not inserted into said fire detector and as well as no smoke is present;

second receiving means for receiving a second received output from said smoke detection portion realized when said light emitting device emits light in a case where said scattering and translucent plate is inserted into said fire detector and as well as no smoke is present;

calculating means for calculating physical quantity characteristics of smoke with respect to said received output of said fire detector or the fire discrimination level in accordance with said first received output, said second received output and the smoke density of said scattering and translucent plate when said second received output has been obtained; and transmission means for transmitting, to said fire detector, the physical quantity characteristics of smoke with respect to said received output of said fire detector or the fire discrimination level obtained by said calculating means, and said fire detector comprises:

transmission means for transmitting at least said first received output and said second received output; and storage means for storing the physical quantity characteristics of smoke with respect to said received output or the fire discrimination level transmitted by said adjustment unit.

22. An adjustment apparatus comprising: a photoelectric type fire detector for transmitting a fire signal in accordance with a received output from a smoke detection portion including a light emitting device and a light receiving device when a physical quantity signal of smoke has been transmitted or when the received output from said smoke detection portion has reached a fire discrimination level; and an adjustment unit for adjusting sensitivity of said photoelectric type fire detector by using a scattering and translucent plate, wherein said adjustment unit comprises:

first receiving means for receiving a first received output from said smoke detection portion realized when said light emitting device emits light in a case where said scattering and translucent plate is not inserted into said fire detector and as well as no smoke is present;

second receiving means for receiving a second received output from said smoke detection portion realized when said light emitting device emits light in a case where said scattering and translucent plate is inserted into said fire detector and as well as no smoke is present;

third receiving means for receiving a third received output from said smoke detection portion realized when said light emitting device does not emit light in a case where said scattering and translucent plate is inserted into said fire detector and as well as no smoke is present;

calculating means for calculating physical quantity characteristics of smoke with respect to said received output of said fire detector or the fire discrimination level based on said first received output, said second received output, said third received output and the smoke density of said scattering and translucent plate when said second received output and said third received output have been obtained; and transmission means for transmitting, to said fire detector, the physical quantity characteristics of smoke with respect to said received output of said fire detector or the fire discrimination level obtained by said calculating means, and said fire detector comprises:

transmission means for transmitting at least said first received output, said second received output and said third received output; and storage means for storing the physical quantity characteristics of smoke with respect to said received output or the fire discrimination level transmitted by said adjustment unit.

23. An adjustment apparatus comprising: a photoelectric type fire detector for transmitting a fire signal in accordance with a received output from a smoke detection portion including a light emitting device and a light receiving device when a physical quantity signal of smoke has been transmitted or when the received output from said smoke detection portion has reached a fire discrimination level; and an adjustment unit for adjusting sensitivity of said photoelectric type fire detector by using a scattering and translucent plate, wherein said adjustment unit comprises:

first receiving means for receiving a first received output from said smoke detection portion realized when said light emitting device emits light in a case where said scattering and translucent plate is not inserted into said fire detector and as well as no smoke is present;

second receiving means for receiving a second received output from said smoke detection portion realized when said light emitting device emits light in a case where said scattering and translucent plate is inserted into said fire detector and as well as no smoke is present;

third receiving means for receiving a third received output from said smoke detection portion realized when said light emitting device does not emit light in a case where said scattering and translucent plate is inserted into said fire detector and as well as no smoke is present;

fourth detection means for detecting a fourth received output from said smoke detection portion realized when said light emitting device does not emit light in a case where said scattering and translucent plate is not inserted into said fire detector and as well as no smoke is present;

first calculating means for calculating physical quantity characteristics of smoke with respect to said received output of said fire detector or the fire discrimination level when said light emitting device emits light in a state where a fire is supervised based on said first received output, said second received output, said third received output, said fourth received output and the smoke density of said scattering and translucent plate when said second received output and said third received output have been obtained;

second calculating means for calculating physical quantity characteristics of smoke with respect to said received output of said fire detector or the fire discrimination level based on said first received output, said second received output, said third received output and the smoke density of said scattering and translucent plate when said second received output and said third received output have been obtained; and transmission means for transmitting, to said fire detector, the physical quantity characteristics of smoke with respect to said received output of said fire detector or the fire discrimination level obtained by said second calculating means, and said fire detector comprises:

transmission means for transmitting at least said first received output, said second received output, said third received output and said fourth received output; and storage means for storing the physical quantity characteristics of smoke with respect to said received output or the fire discrimination level transmitted by said adjustment unit.

* * * * *